US006597887B2

(12) United States Patent
Sakai et al.

(10) Patent No.: US 6,597,887 B2
(45) Date of Patent: Jul. 22, 2003

(54) DUPLEX IMAGE TRANSFERRING DEVICE USING LIQUID TONER DEVELOPMENT

(75) Inventors: Katsuo Sakai, Yokohama (JP); Shunuchi Abe, Yokohama (JP); Yuichi Aoyama, Mitaka (JP)

(73) Assignee: Ricoh Company, Ltd., Tokyo (JP)

( * ) Notice: Subject to any disclaimer, the term of this patent is extended or adjusted under 35 U.S.C. 154(b) by 68 days.

(21) Appl. No.: 09/995,596

(22) Filed: Nov. 29, 2001

(65) Prior Publication Data

US 2002/0064403 A1 May 30, 2002

(30) Foreign Application Priority Data

Nov. 30, 2000 (JP) ..... 2000-364861

(51) Int. Cl.[7] ..... G03G 15/16
(52) U.S. Cl. ..... 399/309
(58) Field of Search ..... 399/306, 309, 399/237, 296, 249, 57, 45, 66, 364; 355/24

(56) References Cited

U.S. PATENT DOCUMENTS

| | | | | |
|---|---|---|---|---|
| 3,936,171 A | * | 2/1976 | Brooke | 399/306 |
| 5,156,308 A | | 10/1992 | Aoyama | |
| 5,247,334 A | * | 9/1993 | Miyakawa et al. | 399/154 |
| 5,248,847 A | | 9/1993 | Aoyama | |
| 5,410,392 A | * | 4/1995 | Landa | 399/308 |
| 5,708,938 A | | 1/1998 | Takeuchi et al. | |
| 5,765,081 A | * | 6/1998 | Bogaert et al. | 399/299 |
| 5,815,783 A | * | 9/1998 | Lior et al. | 399/302 |
| 5,923,930 A | | 7/1999 | Tsukamoto et al. | |
| 5,987,281 A | | 11/1999 | Kurotori et al. | |
| 5,987,282 A | | 11/1999 | Tsukamoto et al. | |
| 6,108,508 A | | 8/2000 | Takeuchi et al. | |
| 6,115,576 A | | 9/2000 | Nakano et al. | |
| 6,148,169 A | | 11/2000 | Tsukamoto | |
| 6,324,374 B1 | | 11/2001 | Sasamoto et al. | |
| 6,347,212 B1 | | 2/2002 | Kosugi et al. | |

FOREIGN PATENT DOCUMENTS

| | | | | |
|---|---|---|---|---|
| GB | 1590872 | * | 6/1981 | G03G/15/16 |
| JP | 09026732 A | * | 1/1997 | G03G/21/00 |

OTHER PUBLICATIONS

U.S. patent application Ser. No. 09/517,082, filed Mar. 01, 2000, pending.
U.S. patent application Ser. No. 09/556,526, filed Apr. 21, 2000.
U.S. patent application Ser. No. 09/892,656, filed Jun. 28, 2001, pending.
U.S. patent application Ser. No. 09/967,101, filed Oct. 01, 2001, pending.
U.S. patent application Ser. No. 10/136,279, filed May 02, 2002, pending.

* cited by examiner

*Primary Examiner*—Robert Beatty
(74) *Attorney, Agent, or Firm*—Oblon, Spivak, McClelland, Maier & Neustadt, P.C.

(57) ABSTRACT

In a duplex image transferring device of the present invention, a first bicolor toner image formed by a developing liquid is transferred to one side of a sheet. This toner image on the sheet includes a carrier liquid layer containing a liquid carrier of an amount not great enough to serve as an electrophoresis medium for a toner layer deposited on the sheet, but sufficient to serve as a parting agent for the toner layer and an intermediate image transfer belt contacting the toner image. Subsequently, a bicolor toner image of the same polarity as the toner layer is transferred to the other side of the sheet. It is possible to transfer the toner images to both sides of the sheet without switching back the one-sided sheet, without using two kinds of toner each being chargeable to particular polarity or without charging one toner image to the opposite polarity with a corona charger.

19 Claims, 16 Drawing Sheets

DUPLEX IMAGE TRANSFERRING DEVICE USING LIQUID TONER DEVELOPMENT

BACKGROUND OF THE INVENTION

1. Field of the Invention

The present invention relates to a duplex image transferring device for transferring toner images from a first and a second image carrier to both sides of a sheet or similar recording medium, and an image forming apparatus using the same.

2. Description of the Background Art

It is generally difficult to transfer two toner images formed by toner of the same polarity to both sides of a single sheet face to face. In light of this, a conventional duplex image transferring device is usually constructed to sequentially pass a sheet through an image transferring device and a fixing device, reverse the sheet, and again pass it through the same route, thereby forming toner images on both sides of the sheet. In such a switchback type of device, the toner image transferred to the sheet first by the first transfer is fixed on the sheet before the second transfer, which causes a reverse electric field to act on the toner image. This promotes desirable transfer of the two toner images to both sides of the sheet.

The switchback type of device, however, needs a sophisticated switchback mechanism for reversing the sheet and then returning it to the image transferring device. Further, switchback obstructs high-speed duplex image transfer. Moreover, the sheet carrying the toner image transferred by the first image transfer extends due to fixation and is therefore likely to dislocate the toner images formed on both sides thereof.

To solve the above problems, Japanese Patent Publication No. 51-13022 and Japanese Patent Laid-Open Publication Nos. 63-63057 and 2-259670, for example, each disclose a particular image forming apparatus using a pair of image carriers. Toner images formed by toner of opposite polarities are respectively formed on the pair of image carriers and then transferred to both sides of a sheet. This type of apparatus, however, need a pair of photoconductive drums, a pair of optical writing units, a pair of developing units and so forth different in specification from each other due to the different polarities of the toner images. The apparatus therefore requires a far greater number of parts than an apparatus of the type dealing with toner of the same polarity, making maintenance troublesome. Maintenance is further aggravated because the toner different only in chargeability from each other must be managed independently of each other.

To promote easy maintenance, there has been proposed an image forming apparatus of the type forming two toner images with toner of the same chargeability and charging, before the transfer of one toner image to a sheet, the toner image with a corona charger to the opposite polarity. This type of apparatus is taught in, e.g., Japanese Patent Laid-Open Publication Nos. 7-77851, 8-211664, 10-171264 and 10-97106 by way of example. Using toner of the same chargeability facilitates maintenance. Further, because the corona charger charges one toner image to the opposite polarity before transfer, two toner images of different polarities are electrostatically moved toward the sheet intervening between them. This makes it needless to transfer one toner image to the sheet beforehand and thereby implements duplex image transfer by a single pass.

However, even the apparatus described above has a problem that corona discharge for reversing the polarity of one toner image scatters the toner to a non-image area around the toner image.

As stated above, an image forming apparatus of the type reversing the polarity of one toner image with a corona charger brings about toner scattering although it solves the problems ascribable to switchback or the use of two different kinds of toner.

Image forming apparatuses in general use either one of dry toner and a developing liquid containing toner and a carrier liquid. We conducted a series of experiments with a test model of an image forming apparatus of the type using a developing liquid. The test model includes an image forming device, a sheet tray, a registration roller pair and so forth. The image forming device includes a photoconductive element or image carrier. Arranged around the drum are a corona charger, an optical writing unit, a developing device, an image transfer roller, discharging mans, and a drum cleaner. The test model forms a latent image on the drum with a conventional electrophotographic process. The developing device stores a developing liquid having viscosity of 100 cSt and containing 15 wt % of toner dispersed in silicone oil or similar insulative carrier liquid. The developing liquid is deposited on a developing roller. A power supply applies a bias for development to the developing roller, so that an electric field for development is formed at a developing position between the drum and the developing roller. The electric field causes the toner of the developing liquid to migrate toward the latent image formed on the drum by electrophoresis, thereby forming a corresponding toner image. The drum in rotation conveys the toner image to a nip between the drum and the image transfer roller.

A pickup roller pays out a sheet from the sheet tray in synchronism with the image formation of the image forming device. The registration roller pair nips the sheet and then drives it toward the nip at a preselected timing such that the leading edge of the sheet meets the leading edge of the toner image. A power supply applies a bias for image transfer to the image transfer roller, forming an electric field at the nip. The toner image is therefore transferred from the drum to the sheet due to the electric field and a nip pressure. After the image transfer, the drum cleaner cleans the surface of the drum with a cleaning blade.

In a machine for practical use, a fixing device is positioned at a preselected position, so that the sheet moved away from the nip is passed through the fixing device. The fixing device was intentionally removed from the test model for convenience.

One day, we conducted experiments with a certain intention by reusing, for a resource and cost saving purpose, sheets carrying unfixed images on one side thereof and transferring toner images to the other side of the same sheets. It was a surprise to find that toner images were transferred to the other side of each sheet without the unfixed toner image on one side of the same sheet being reversely transferred to the image transfer roller. We first doubted this result because the one-sided sheets had been simply stored over a long time after image transfer. However, the result of continuous transfer of toner images to both sides of sheets was the same as the above result. The experiments therefore taught us that duplex image transfer was achievable without resorting to two different kinds of toner or a corona charger for reversing the polarity of one toner image. Although some toner was left on the image transfer roller after duplex image transfer, it was negligible in practical use.

When coated sheets were substituted for plain sheets used for the experiments, the amount of toner left on the coated sheets was reduced to about one-half of the toner left on the plain sheets. When porous sheets, which are highly liquid-absorptive, were substituted for the plain sheets, the amount of residual toner was too great to be called "residual toner" and brought about reverse transfer. This was also true with OHP (OverHead Projector) sheets, which are not liquid-absorptive at all.

The results of the experiments described above suggest the following. When a second toner image is transferred to the other side of a sheet carrying a first toner image on one side (second transfer), the carrier liquid of the first toner image serves as a parting agent that causes the toner image to part from the image transfer roller and thereby obstructs reverse transfer. More specifically, the developing liquid or colored liquid contains far smaller toner grains than dry toner.

At the time of the first transfer, fine toner grains constituting a toner image densely gather at a sheet by electrophoresis under the action of an electrostatic force. The electrostatic force and nip pressure cooperate to press the toner grains against the sheet. As a result, the toner grains adhere more strongly to each other and form a single mass with hardly any carrier liquid intervening between the grains. In parallel with this, the sheet absorbs the carrier liquid of the developing liquid little by little. When the first transfer is about to end, the sheet absorbs most of the liquid carrier with only a small amount of carrier liquid remaining on the toner mass in the form of a layer.

At the time of the second transfer, a reverse electric field acts on the toner mass transferred to the sheet first. At this instant, the toner mass tends to rather bodily move in the reverse section than migrates by electrophoresis because the liquid carrier is short. The small amount of carrier liquid left on the toner mass intervenes between the toner mass and the image transfer roller and serves as a parting agent. As for a coated sheet lower in liquid absorbability than a plain sheet, a greater amount of liquid carrier remains than on a plain sheet. This suggests that the parting effect is further enhanced to obstruct reverse transfer more positively. As for a porous sheet highly liquid-absorptive, an amount of carrier liquid great enough to serve as a parting agent presumably does not remain on the toner mass, so that the toner mass is reversely transferred to the image transfer roller due to the electric field. Further, as for an OHP sheet not liquid-absorptive, an amount of carrier liquid great enough to serve as an electrophoresis medium rather than a parting agent remains on the toner mass, causing the toner to easily migrate in the reverse direction by electrophoresis under the action of the reverse electric field.

SUMMARY OF THE INVENTION

It is therefore an object of the present invention to provide a duplex image transferring device capable of transferring toner images to both sides of a recording medium without switching back a one-sided recording medium or using two kinds of toner different in chargeability or charging one toner image to the opposite polarity with a corona charger, and an image forming apparatus using the same.

A duplex image transferring method of the present invention begins with a step of bringing one side of a recording medium into contact with a first toner image, which is formed on a first image carrier by a colored liquid containing toner and a carrier liquid. A first electric field acts toward the recording medium in a forward direction to thereby transfer the first toner image to the one side of the recording medium. At the same time, a toner layer gathered at the recording medium and a carrier liquid layer left on the first image carrier are caused to part from each other. In a second step, the other side of the recording medium is brought into contact with a second toner image formed on a second image carrier by the color liquid. At this instant, first toner image, in which the liquid carrier layer contains the carrier liquid of an amount not great enough to serve as an electrophoresis medium for the toner layer, but sufficient to serve as a parting agent for the toner layer and a contact member contacting the toner layer, is maintained on the one side of the recording medium. Subsequently, a second electric field, which acts toward the recording medium and forward for the second toner image, but reverse for the first toner image, acts on the second toner image and first toner image to thereby transfer the second toner image to the other side of the recording medium.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

To better understand the present invention, brief reference will be made to conventional schemes for duplex image transfer. It is generally difficult to transfer two toner images formed by toner of the same polarity to both sides of a single sheet face to face, as stated earlier. This will be described specifically with reference to FIG. 1.

Figure 1:
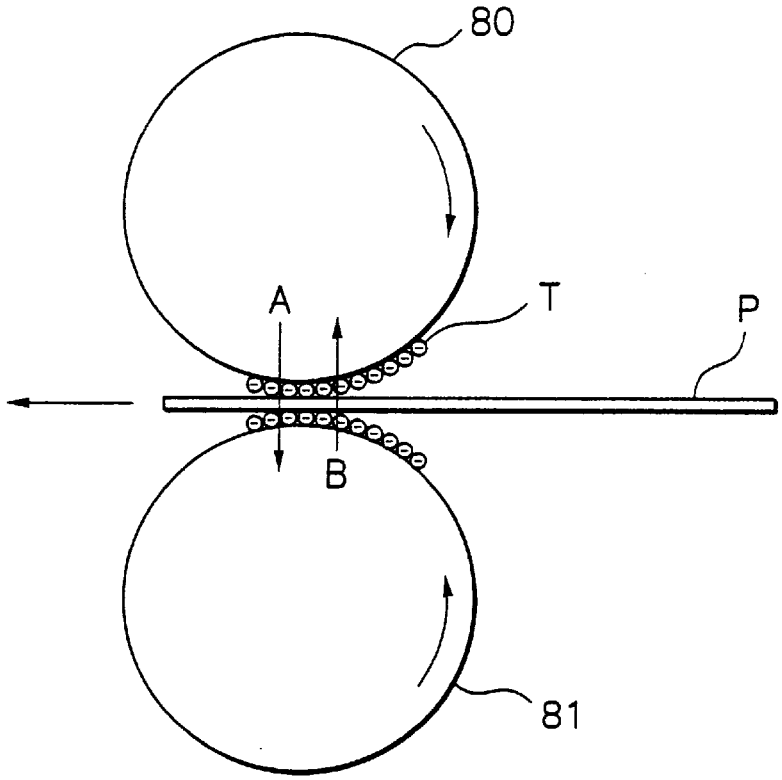
Fig. 1 PRIOR ART
FIG. 1 is a view showing two intermediate image transfer drums and a sheet nipped between them.

As shown in FIG. 1, assume that a particular toner image is formed on each of two intermediate image transfer drums 80 and 81 by toner grains T charged to negative polarity, and that a sheet P is nipped between the drums 80 and 81. To transfer the toner image from the drum 80 to the front side of the sheet P (upper surface in FIG. 1), an electric field that exerts an electostatic force directed from the drum 80 toward the drum 81 (arrow A) on the toner grains T of negative polarity must be formed between the drums 80 and 81. On the other hand, to transfer the toner image from the drum 81 to the reverse side of the sheet P (lower surface in FIG. 1), an electric field that exerts an electrostatic force directed in the opposite direction (arrow B) on the toner grains T of negative polarity must be formed between the drums 80 and 81.

In practice, however, it is impossible to form electric fields opposite in directions between the drums 80 and 81 at the same time. Although an alternating electric field may be used, it reverses its direction halfway and reversely transfers one of the two toner images from the sheet P to the drum 80 or 81. Even when the sheet P carrying one toner image on its front side is reversed in order to form the other toner image on the reverse side, the condition shown in FIG. 1 also occurs at the time of the second image transfer, resulting in reverse transfer. A switchback type of image forming device constructed to solve this problem has some problems left unsolved, as stated earlier.

Figure 2:
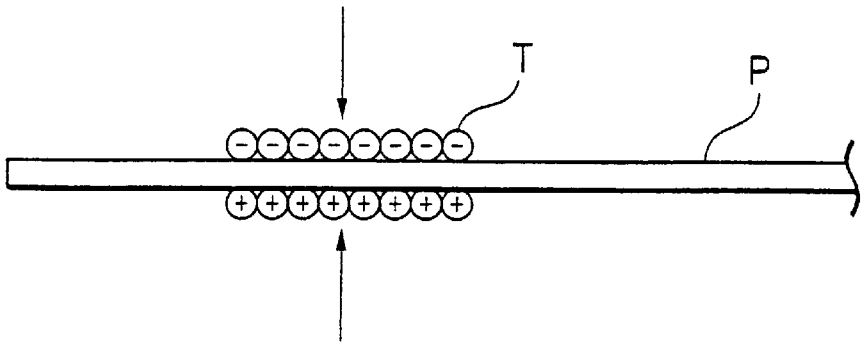
Fig. 2 PRIOR ART
FIG. 2 is a view showing two toner images transferred to both sides of the sheet face to face.

FIG. 2 shows the previously mentioned prior art image forming apparatus of the type forming toner images with toner of opposite polarities on a pair of image carriers and then transferring them to both sides of a sheet. As shown, at the time of the second image transfer or the time of duplex, simultaneous transfer, toner images of opposite polarities face each other with the intermediary of a sheet P. Assume that toner grains T deposited on one side of the sheet P and charged to negative polarity are subjected to an electric field that exerts an electrostatic force toward the sheet P. Then, the toner T deposited on the other side of the sheet P and charged to positive polarity is also subjected to an electrostatic force directed toward the sheet P. This makes it needless to fix one toner image on the sheet P beforehand and therefore allows toner images to be transferred to both sides of the sheet P by a single pass without switching back the sheet P. Even this type of image forming apparatus has the problems discussed earlier.

Figure 3:
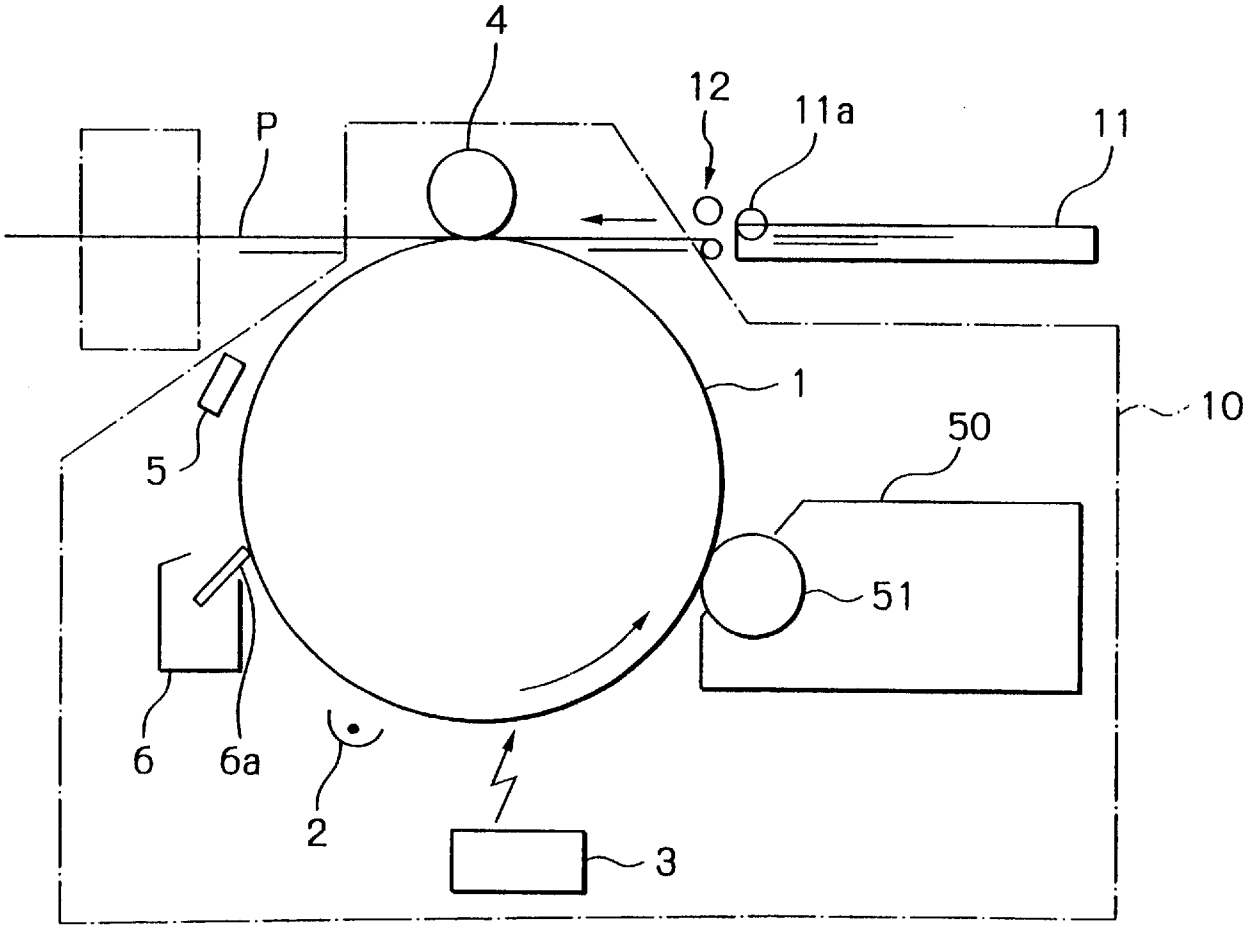
FIG. 3 is a view showing a test model of an image forming apparatus using a developing liquid.

FIG. 3 shows the previously mentioned test model of an image forming apparatus using a developing liquid and prepared by us. The developing liquid contains toner and a carrier liquid. As shown, the test model includes a photoconductive drum 1, a corona charger 2, an optical writing unit 3, an image transfer roller 4, discharging means 5, a drum cleaner 6 including a cleaning blade 6*a*, and an image forming device 10. The test model further includes a sheet tray 11, a pickup roller 11*a*, a registration roller pair 50, a developing roller 51, and a sheet P. The operation of the test model and the results of experiments conducted therewith have already been described.

Figure 4:
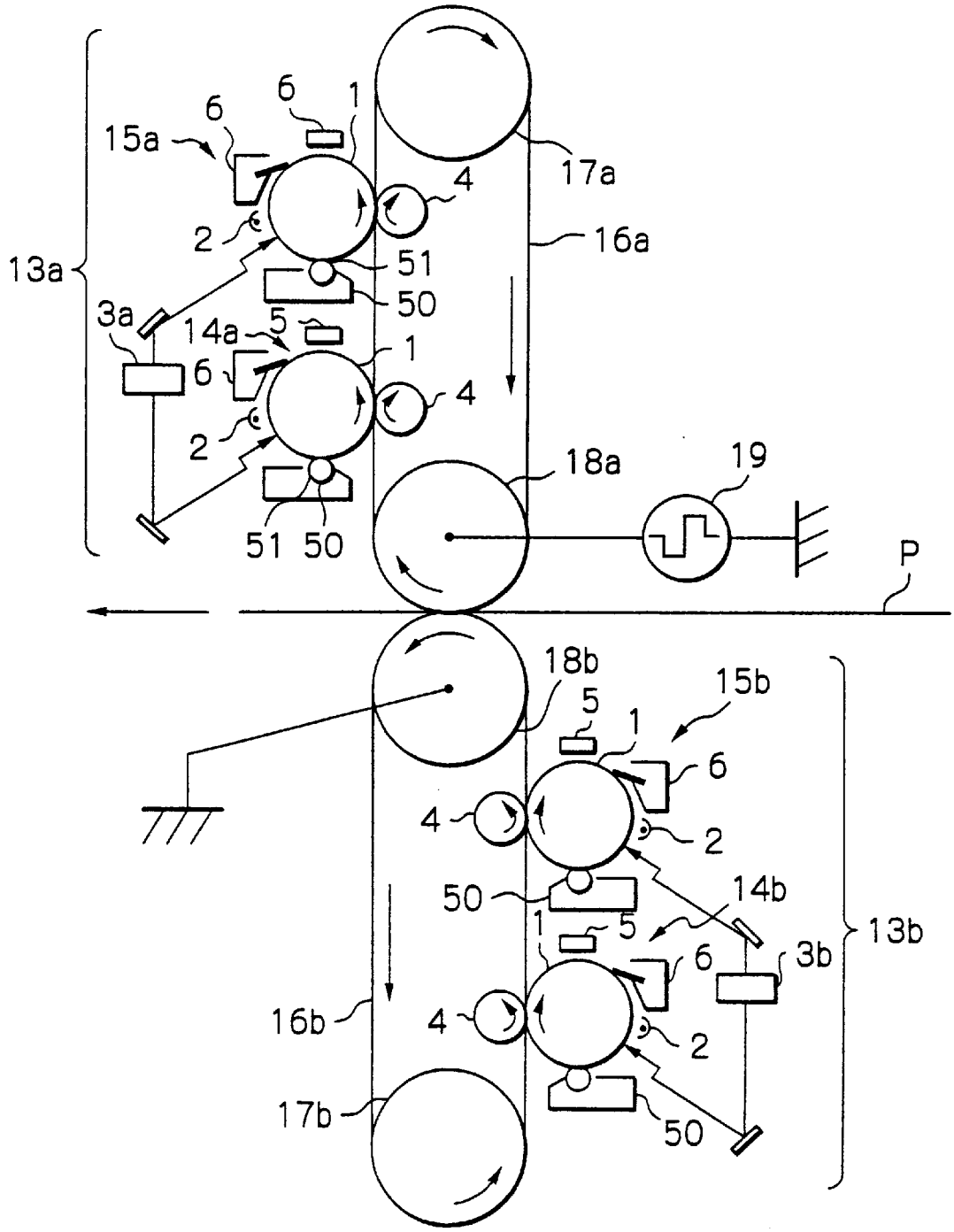
FIG. 4 is a view showing the general construction of an image forming apparatus using a developing liquid in accordance with the present invention and implemented as a printer by way of example.

Referring to FIG. 4 of the drawings, the general construction of an image forming apparatus in accordance with the present invention is shown and implemented as an electrophotographic printer using a developing liquid by way of example. As shown, the printer is generally made up of a first image forming unit 13*a* and a second image forming unit 13*b*.

The first image forming unit 13*a* includes two image forming devices 14*a* and 15*a*, an optical writing unit 3*a*, an intermediate image transfer belt or first image carrier (simply belt hereinafter) 16*a*, a drive drum 17*a*, driven drum 18*a*, and an AC power supply 19. The belt 16*a* includes a 0.3 mm thick, endless urethane resin film. A 0.3 mm thick, urethane rubber layer and a 0.1 to 1.0 $\mu$m thick, non-crystalline fluorocarbon resin layer are stacked on the above film. The entire belt 16*a* has volume resistivity of about $10^8$ $\Omega$·cm. The belt 16*a* is passed over the drive drum 17*a* and driven drum 18*a*. Drive means, not shown, drives the drive drum 17*a* and thereby causes the belt 18*a* to turn in a direction indicated by an arrow in FIG. 4.

The image forming devices 14*a* and 15*a* each include a photoconductive drum 1, a corona charger 2, an image transfer roller 4, discharging means 5, a drum cleaner 6 and a developing device 5. The image forming devices 14*a* and 15*a* share the optical writing unit 3*a*.

The image forming device 14*a* executes the following image forming process. While the drum 1 is rotated in a direction indicated by an arrow in FIG. 4, the corona charger 2 uniformly charges the surface of the drum 1 to a preselected potential. The optical writing unit 3*a* scans the charged surface of the drum 1 with a laser beam in accordance with image data, thereby forming a latent image on the drum 1. The drum 1 in rotation conveys the toner image to a developing position where the drum 1 faces the developing device 50.

The developing device 50 stores a developing liquid consisting of a carrier liquid and 15 wt % of toner and an adequate amount of charge control agent (CCA) dispersed in the carrier liquid. The carrier liquid is implemented by silicone oil or similar insulative liquid. The developing liquid has viscosity of 100 cSt. The toner in the carrier liquid is charged to positive polarity.

The developing device 50 includes a developing roller or developer carrier 51 caused to rotate by drive means not shown. The developing liquid, or colored liquid, deposits on the developing roller 51 while the roller 51 is in rotation. A power supply, not shown, applies a bias for development to the developing roller 51, so that an electric field is formed at the developing position between the roller 51 and the drum 1. The electric field develops the latent image arrived at the developing position by reversal development, thereby producing a corresponding toner image. More specifically, the toner between the developing roller 51 and the latent image of the drum 1 electrostatically migrates toward the latent image by electrophoresis and deposits on the latent image. On the other hand, part of the toner present between the developing roller 51 and the background of the drum 1 electrostatically migrates toward the developing roller 51 by electrophoresis. As a result, the background of the drum 1 forms a non-image area.

The drum 1 and image transfer roller 4 contact each other with the intermediary of the belt 16*a*, and each rotates in a forward direction. The drum and roller 4 form a nip for primary image transfer therebetween. A power supply, not shown, applies a bias for image transfer to the image transfer roller 4, forming an electric field at the above nip. When the drum 1 in rotation conveys the toner image to the nip, the toner image is transferred from the drum 1 to the belt 16*a* due to the electric field and nip pressure. Let this image transfer be referred to as primary image transfer hereinafter. The major component of toner grains forming the toner image is binder resin. Therefore, when the toner grains are pressed against the surface of the belt 16*a* by the electric field and compressed thereby, they strongly adhered to each other and form a firm mass.

After the primary image transfer, the discharging means discharges the surface of the drum 1. Subsequently, the drum cleaner 6 removes toner grains left on the drum 1 with a blade not shown.

The other image forming device 15*a* forms a toner image on its drum 1 in the same manner as the image forming device 14*a* described above. The image forming device 15*a*, however, develops a latent image formed on the drum 1 in a color different from the color of the image forming device 50*a*, i.e., with toner of a different color. The toner image formed by the image forming device 15*a* is transferred to the belt 16*a* over the toner image formed by the image forming device 14*a* (primary image transfer). Toner grains forming the toner image are pressed against and joined with the toner grains existing on the belt 16*a*. Consequently, the belt 16*a* conveys the resulting bicolor toner image to a nip for secondary image transfer, which will be described specifically later.

The AC power supply 19 applies an AC bias for secondary image transfer to the driven drum 18*a*.

The second image forming unit 13*b* also includes two image forming devices 14*b* and 15*b*, an optical writing unit 3*b*, an intermediate image transfer belt or second image carrier (simply belt hereinafter) 16*b*, a drive drum 17*b*, and a driven drum 18*b*. The driven drum 18*b* differs from the driven drum 18*a* in that it is connected to ground. The belt 16*b* is identical in configuration with the belt 16*a*.

The driven drum 18*b* is pressed against the driven drum 18*a*, forming the nip for secondary image transfer mentioned above. A bicolor toner image is formed on the belt 16*b* in the same manner as in the first image forming unit 13*a*. The belt 16*b* conveys the bicolor toner image to the above nip in synchronism with the arrival of the bicolor toner image at the nip for secondary image transfer in the first image forming unit 13*a*.

A sheet feeder, not shown, feeds a sheet or similar recording medium P to the nip for secondary image transfer such that the leading edge of the sheet P meets the leading edges of the two bicolor toner images. Consequently, at the nip, the two belts 16*a* and 16*b* sandwich the bicolor toner image formed by the first image forming unit 13*a*, sheet P, and bicolor toner image formed by the second image forming unit 13*b*. The AC bias applied to the driven drum 18*a* forms an alternating electric field at the nip. This electric field causes one of the two bicolor images to be transferred to one side of the sheet P and then causes the other bicolor image to be transferred to the other side of the sheet P (secondary image transfer). The sheet P carrying the toner images on both sides thereof is driven out of the printer via a fixing device.

Figure 5:
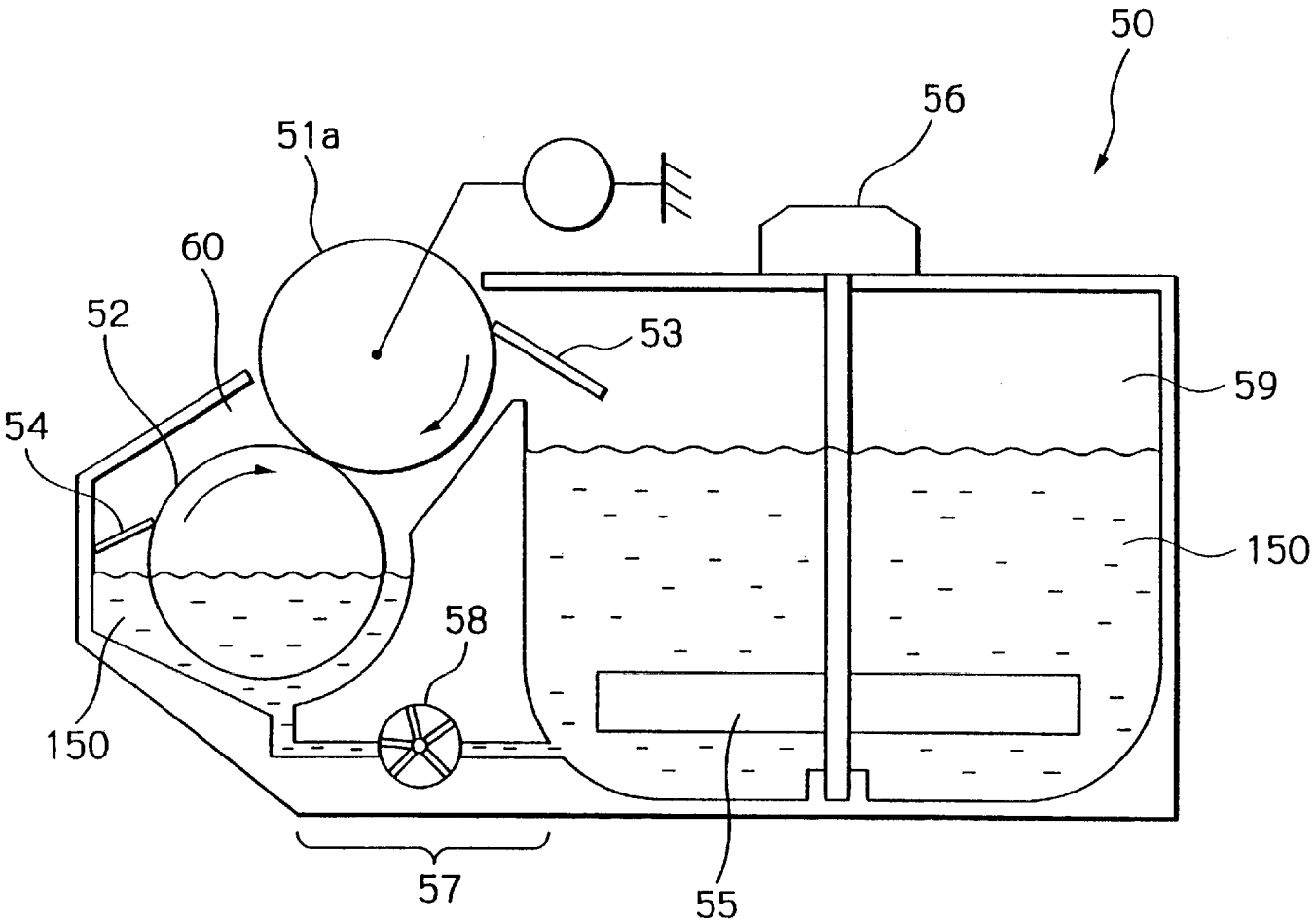
FIG. 5 is a view showing a developing device included in the printer of FIG. 4.

FIG. 5 shows the developing device 50 more specifically. As shown, the developing device 50 is generally made up of a pump section 57, a tank section 59, and a developing section 60. The pump section 57 fluidly communicates the tank section 59 and developing section 60 and has an impeller 58 positioned in its passage. The impeller 58 is formed of rubber or similar elastic material and rotated by drive means not shown. When the impeller 58 is not rotated, it closely contacts the inner wall of the above passage to thereby block the passage. The impeller 58, when rotated in the forward or the reverse direction, propels a developing liquid 150 and thereby conveys it between the tank section 59 and the developing section 60.

More specifically, just before the body of the developing device 50 enters into a stand-by state, the impeller 58 is rotated in the reverse direction to return the entire developing liquid 150 in the developing section 60 to the tank section 59. Just before the body of the developing device 50 starts development and during development, the impeller 58 is suitably rotated in the forward direction to replenish an adequate amount of developing liquid 150 to the developing section 60. The replenishment is controlled on the basis of the output of sensing means, not shown, responsive to a liquid level in the developing section 60.

An agitator 55 is disposed in the tank section 59 and rotated by a motor 56 for thereby agitating the developing liquid in the tank.

The developing section 60 includes a developing roller 51*a*, a coating roller 52, a cleaning blade 53, and a metering blade 54. The developing roller 51*a* and coating roller 52 contact each other to form a nip and are rotated in directions counter to each other. The coating roller 52 in rotation conveys the developing liquid 150 in the developing section 60 upward toward the developing roller 51*a*. At this instant, the metering blade 54 regulates the thickness of a film formed by the developing liquid 150 on the coating roller 52. On reaching the above nip, the film on the coating roller 52 is partly applied to the developing roller 51*a*, forming a thin developer layer. The developing roller 51 *a* in rotation conveys the developer layer to a developing position where the roller 51*a* faces the photoconductive drum not shown. At the developing position, the developer layer develops a latent image formed on the drum. The cleaning blade 53 removes the developer layer left on part of the developing roller 51*a* moved away from the developing position and returns it to the tank section 59.

[Duplex Transfer Test 1]

A test printer with the configuration described above was produced and operated under the following conditions. The belts 16*a* and 16*b* and drums 1 each were moved at a linear velocity of 300 mm/sec (process linear velocity hereinafter). The nip for secondary image transfer was 45 mm wide. A period of time of 150 mm/sec was necessary for the sheet P to pass through the above nip. The sheet P was implemented by a plain sheet Type 6000 available from RICOH, CO., LTD. The bias for secondary image transfer was 2 kvp-p (peak-to-peak) and had a period T of 100 msec and a rectangular waveform. The test printer successfully transferred dense, sharp bicolor toner images to both sides of the sheet P.

Although some toner grains were left on the belts 16*a* and 16*b* after the secondary image transfer, they were not critical at all in actual use. For reference, a mending tape available from 3M was put on one of the belts 16*a* and 16*b* where more toner grains were left and then removed to measure image density on a white sheet. The image density was measured to be as low as 0.054 ID. The bicolor toner image transferred to the sheet P and corresponding to such residual toner had image density of about 1.20 ID. Therefore, the reverse transfer ratio is as small as 4.5%, which does not matter at all in practical use.

[Duplex Transfer Test 2]

Duplex transfer test 1 was repeated except that the plain sheet was replaced with a coated sheet. It was found that the image density of the residual toner on the belt was lowered even to 0.029 ID. Because the bicolor toner image transferred to the sheet P and corresponding to such residual toner was 1.20 ID as in duplex transfer test 1, the reverse transfer ratio was as low as 2.4%.

[Duplex Transfer Test 3]

Duplex transfer test 1 was repeated except that the plain sheet was replaced with an OHP sheet. A bicolor toner image transferred to one side of the OHP sheet P was too low in quality to withstand practical use. Specifically, many spots appeared in a solid image portion while defects appeared in a text image portion. In addition, the edges of the image were blurred. Moreover, much toner was left on the belt on which the above bicolor image was formed.

[Duplex Transfer Test 4]

Duplex transfer test 1 was repeated except that the plain sheet was replaced with a porous sheet. One of two bicolor toner images transferred to the porous sheet P had image density lowered from 1.20 ID to about 0.60 ID. Further, much toner was left on the belt on which the above toner image was formed.

The results of duplex transfer tests 1 through 4 taught us that one of the two bicolor images transferred to the sheet P first suffered from a minimum of reverse transfer when the other bicolor toner image was transferred to the sheet P, in spite of the reverse electric field acting thereon. This is presumably because the carrier liquid served as a parting agent.

Figure 6C:
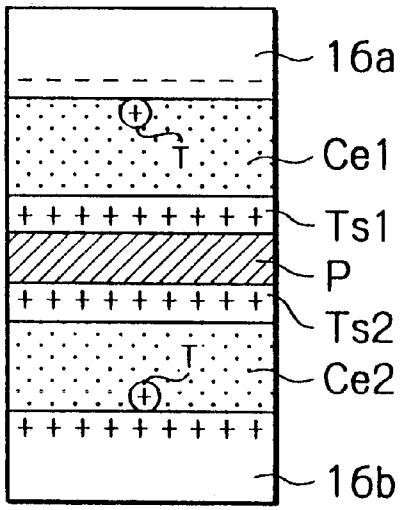
FIG. 6 is an enlarged view showing the conditions of toner images as viewed at a nip for secondary image transfer.
Figure 6B:
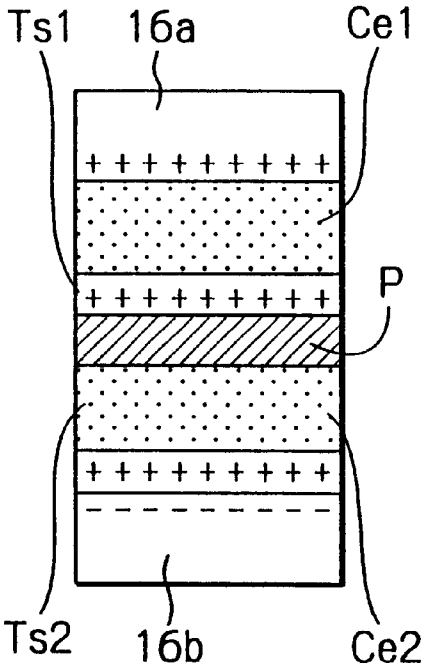
Figure 6A:
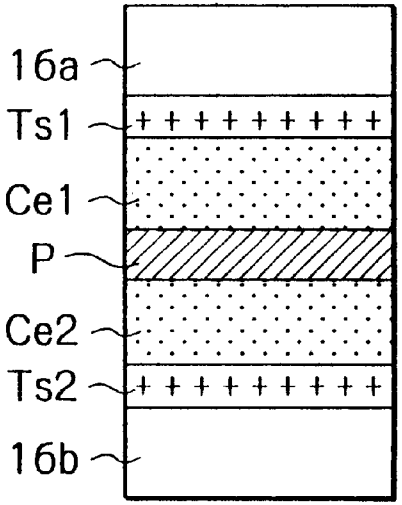

FIGS. 6, (*a*) through (*c*), demonstrate a phenomenon presumably occurring at the nip for the secondary image transfer. As shown in FIG. 6, (*a*), a bicolor toner mass Ts1, a carrier liquid layer Ce1, the sheet P, a carrier liquid Ce2 and a bicolor toner mass Ts2 are sandwiched in this order between the two belts 16*a* and 16*b*. Assume that the alternating electric field acts in such a direction that it causes toner T charged to positive polarity to electrostatically move downward, as viewed in FIG. 6, (*a*). Then, the toner mass Ts1 deposited on the fluorocarbon resin layer, which is highly liquid-repellant, of the belt 16*a* immediately leaves the resin layer and migrates by electrophoresis. As a result, as shown in FIG. 6, (*b*), the toner mass Ts1 is electrostatically pressed against the sheet P and adheres to the sheet P.

When the direction of the alternating electric field is reversed, the toner mass Ts2 deposited on the fluorocarbon resin layer of the belt 16*b* immediately leaves the resin layer and migrates through the carrier liquid Ce2 toward the sheet P by electrophoresis. At this instant, the toner mass Ts1 adhered to the sheet P is also subjected to an electrostatic force that urges it back to the belt 16*a*. However, the toner mass Ts1 does not immediately start moving toward the belt 16*a* because the sheet P takes in part of the toner in its fibers while absorbing the carrier liquid. Moreover, the sheet P has already absorbed much carrier liquid, so that the carrier liquid layer Ce1 at the belt 16*a* side (shown in an exaggerated scale) is extremely thin. The carrier liquid layer Ce1 therefore serves as a parting agent for promoting the separation of the toner mass Ts1 from the belt 16*a* rather than an electrophoresis medium. On the other hand, the carrier liquid layer Ce2 contacting the other side of the sheet P is continuously absorbed by the sheet P and therefore plays the role of an electrophoresis medium rather than a parting agent. Consequently, as shown in FIG. 6, (*c*), the toner masses Ts1 and Ts2 deposit on both sides of the sheet P, leaving only a small amount of toner T on the belts 16*a* and 16*b*.

It is to be noted that the direction of the alternating electric field to act on the laminate shown in FIG. 6 is dependent on the timing at which the sheet P enters the nip for secondary image transfer. Therefore, it may occur that the toner mass Ts2 is transferred to the sheet P before than the toner mass Ts1.

The apparatus of the present invention uses a developing liquid having viscosity as high as 100 cSt and a toner content as high as 15 wt %. We recently developed an image forming system using such a viscous, dense developing liquid. It was traditional to use a developing liquid having viscosity of 1 cSt to 5 cSt and a toner content of 1 wt % to 3 wt %. Such a developing liquid causes much carrier liquid to remain even when absorbed by the sheet P at the nip for secondary image transfer, so that a toner mass readily migrates due to electrophoresis. Presumably, this kind of developing liquid makes image transfer extremely difficult when applied to the present invention. Presumably, therefore, it desirable to control toner content to 10 wt % or above.

By conducting electrophoresis tests to be described hereinafter, we confirmed that a developing liquid with high viscosity and a high toner content delayed the reverse electrophoresis of toner under the action of a reverse electric field than a developing liquid with low viscosity and low toner content.

[Electrophoresis Test 1]

Figure 7:
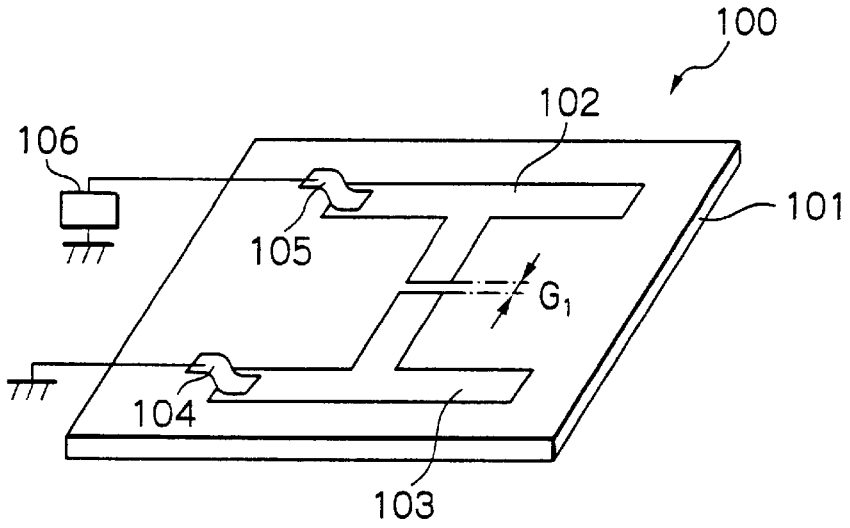
FIG. 7 is a perspective view showing an electrophoresis testing device that we prepared.

FIG. 7 shows an electrophoresis testing device 100 that we prepared to observe the electrophoresis of toner in a developing liquid or colored liquid. As shown, the testing device 100 includes a transparent glass plate 101. A second, T-shaped transparent electrode 102 is positioned on the glass plate 101. Also, a first, T-shaped transparent electrode 103 is positioned on the glass plate 101 line-symmetrically to the second electrode 102 and spaced from the electrode 102 by a gap G1. The first and second electrodes 102 and 103 each are 0.15 $\mu$m thick and formed of ITO (indium tin oxide). A conductive tape 105 connects one end of the second electrode 102 to a power supply 106. Likewise, a conductive tape 104 connects one end of the first electrode 103 to ground.

Figure 8:
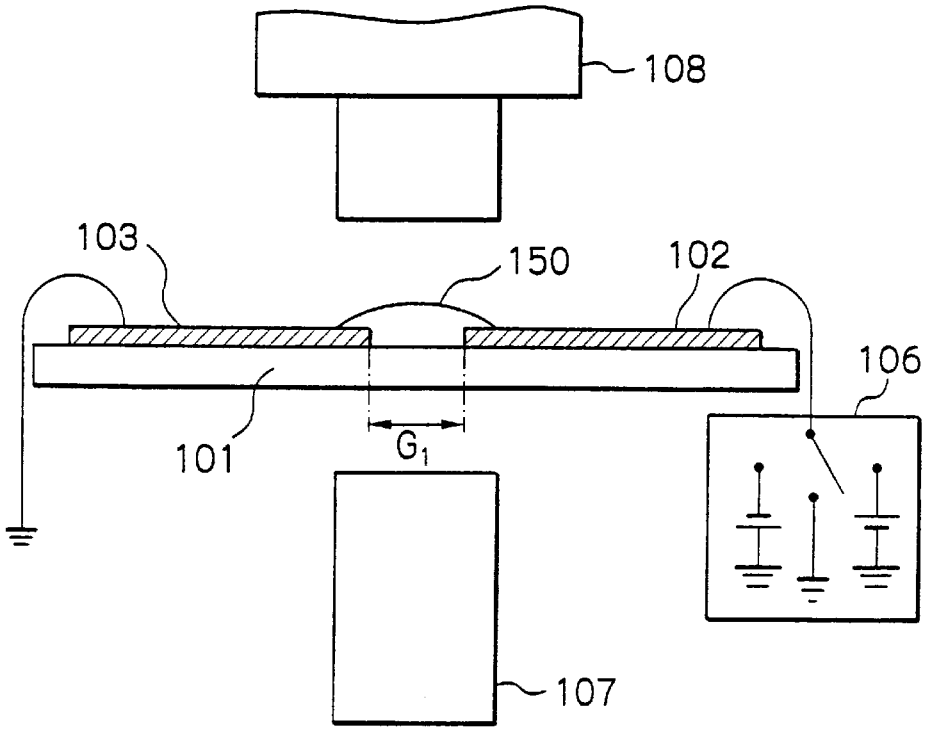
FIG. 8 is a view demonstrating an electrophoresis test practicable with the device of FIG. 7.

For an electrophoresis test, use was made of a developing liquid having viscosity of 100 cSt and in which 15 wt % of toner was dispersed in an insulative carrier liquid. More specifically, as shown in FIG. 8, the developing liquid 150 was dropped to the gap GI and then squeezed to thickness of about 20 $\mu$m. The testing device 100 was then positioned between a high-speed video camera 108 (Kodak high speed filming camera Model 4540) loaded with a ×50 object lens and a cold light 107. In this condition, the power supply 106 applied a DC voltage of +1,000 V to the second electrode 102 via the conductive tape 105. The video camera 108 picked up toner migrating from the second electrode 102 toward the first electrode 103 by electrophoresis.

Figure 9:
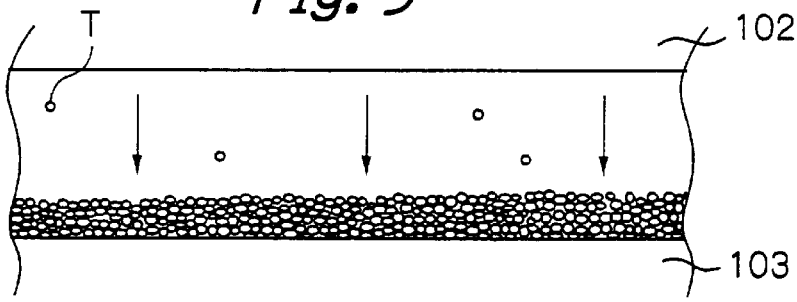
FIG. 9 is a sketch showing how toner grains migrate by electrophoresis, observed via the device of FIG. 7.

The toner started migrating toward the first electrode 103 just after the application of the DC voltage from the power supply 106. As shown in FIG. 9, only in several hundred milliseconds, most of the toner gathered at the first electrode 103. The first electrode 103 collected the toner corresponds to a sheet at the first image transfer step while the second electrode 102 released the toner corresponds to the drum 1.

Figure 10:
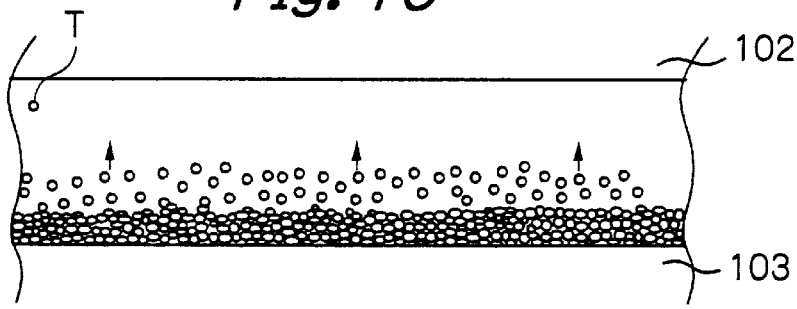
FIG. 10 is a sketch showing the condition of the toner grains observed on the elapse of 40 msec by forming a reverse electric field in the condition of FIG. 9.

To cause a reverse electric field to act on the toner gathered at the first electrode 103, the output voltage of the power supply 106 was switched from+1,000 V to −1,000 V. Then, the toner did not start electrophoresis just after the switching of the voltage, but started it with some time lag. Moreover, as shown in FIG. 10, not the entire toner started migrating together, but the toner started migrating little by little from the surface of the mass. This is presumably because adhesion acting between the toner mass and the first electrode 103 is stronger than adhesion acting between toner grains. FIG. 10 shows a condition observed in 40 msec since the switching of the voltage.

[Electrophoresis Test 2]

Electrophoresis test 1 was repeated except that use was made of a developing liquid with a toner content of 3 wt %. When the reverse electric field acted on toner gathered at the first electrode 103, the toner immediately started electrophoresis without any time lag. The time lag particular to the viscous, dense developing liquid is presumably accounted for by the viscous carrier liquid that plays the role of a binder between the gathered toner grains.

As stated above, when a viscous, dense developing liquid and a plain sheet or a coated sheet are used in combination, the carrier liquid remains on the bicolor toner image transferred first in an amount adequate to play the role of a parting agent. Such an amount of carrier liquid successfully obstructs the reverse transfer of the bicolor image at the time of transfer of the next bicolor toner image.

Electrophoresis test 3 to be described hereinafter showed that when the belts 16*a* and 16*b* each were coated with non-crystalline fluorocarbon resin, the reverse transfer of the bicolor image at the nip was further obstructed.

[Electrophoresis Test 3]

Figure 11:
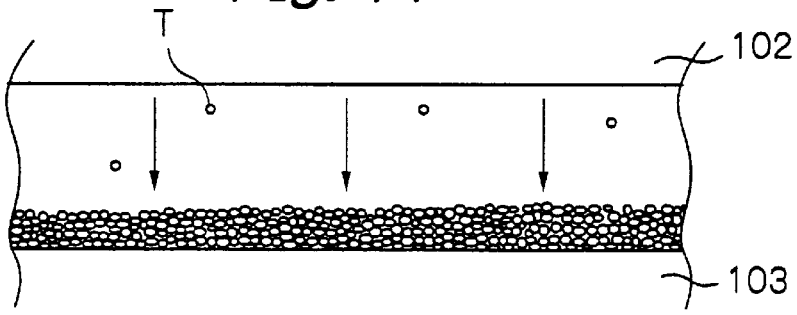
FIG. 11 is a view similar to FIG. 9, showing the migration of toner grains observed with an improved version of the device of FIG. 7.
Figure 12:
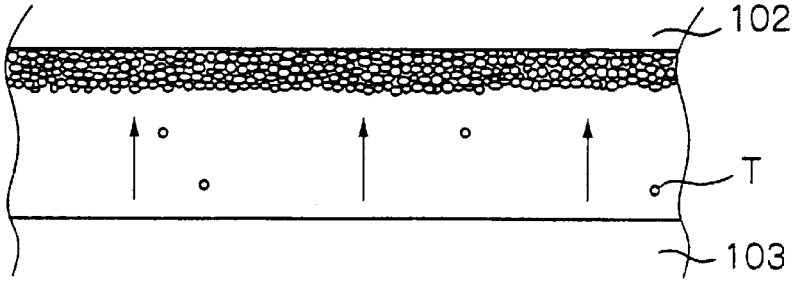
FIG. 12 a sketch showing the condition of the toner grains observed on the elapse of 40 msec by forming a reverse electric field in the condition of FIG. 11.

Electrophoresis test 1 was repeated except that the first electrode 103 was coated with a non-crystalline fluorocarbon resin layer. As shown in FIG. 11, toner gathered at the first electrode 103 in several hundred milliseconds as in electrophoresis test 1. The difference is that just after the application of the reverse electric field, the entire toner started electrophoresis in the form of a mass. Finally, as shown in FIG. 12, the entire toner reached the second electrode 102 in 40 msec, which is only about one-tenth of several hundred milliseconds. When toner grains migrate by electrophoresis independently of each other, the turbulence of carrier liquid occurs between the toner grains and obstructs electrophoresis. By contrast, when the toner grains migrate in the form of amass, the turbulence does not occur. This presumably quickens electrophoresis. Further, why the individual toner grains started migrating in the form of a mass is presumably that adhesion acting between the fluorocarbon resin layer, which is extremely substance-repellent, and the toner is far weaker than adhesion acting between the toner grains, allowing the mass to readily leave the resin layer.

As for the primary transfer of each bicolor image to the associated belt, the toner gathers on the belt by electrophoresis and form a mass thereon. The toner mass forming the second bicolor toner image to be transferred to the sheet P can smoothly start migrating away from the fluorocarbon resin layer under the action of the electric field. The toner mass forming the first bicolor image has strongly adhered to the sheet P and therefore cannot immediately start migrating in the reverse direction when subjected to the reverse electric field. If the toner mass forming the second bicolor image migrates in the reverse direction before the start of the reverse migration of the first bicolor image, then the reverse transfer of the first bicolor image can be further obstructed. Even if the first bicolor image starts reverse migration before the reverse migration of the second bicolor image, the carrier liquid layer overlying the first bicolor image plays the role of a parting agent. This, coupled with the fluorocarbon resin layer repellent to toner, further obstructs reverse transfer.

For the fluorocarbon resin layer, use is made of SITOP (trade name) available from Asahi Glass, Co, Ltd. or a silicon-containing organic fluorine-contained polymer disclosed in Japanese Patent No. 2,874,715 (DAIKIN INDUSTRIES LTD.). Such a material allows pure fluorocarbon resin to be coated on a urethane rubber layer. Before the development of the above materials, it was extremely difficult to coat pure fluorocarbon resin on urethane rubber; in many cases, a mixture of fluorocarbon resin and another binder resin was used at the sacrifice of the liquid-repellence of a belt and a parting ability. Even if pure fluorocarbon resin could be coated on urethane rubber, the resulting coating layer lacked in durability and came off soon.

As stated above, the present invention makes it needless to switch back the sheet P carrying a toner image on one side, to use two kinds of toner each being chargeable to particular polarity or to charge one toner image to the opposite polarity with a corona charger.

It is to be noted that the developing liquid refers to a developing liquid of the kind specified by the manufacturer or a sales agent.

Hereinafter will be described preferred embodiments of the present invention each including a unique arrangement in addition to the general configuration described above. While the illustrative embodiment described above realized desirable duplex image transfer with a plain sheet and a coated sheet, it brought about reverse transfer of one of two bicolor toner images with an OHP sheet or a porous sheet, as stated earlier. A first embodiment of the present invention to be described is constructed in order to solve this problem.

Figure 13:
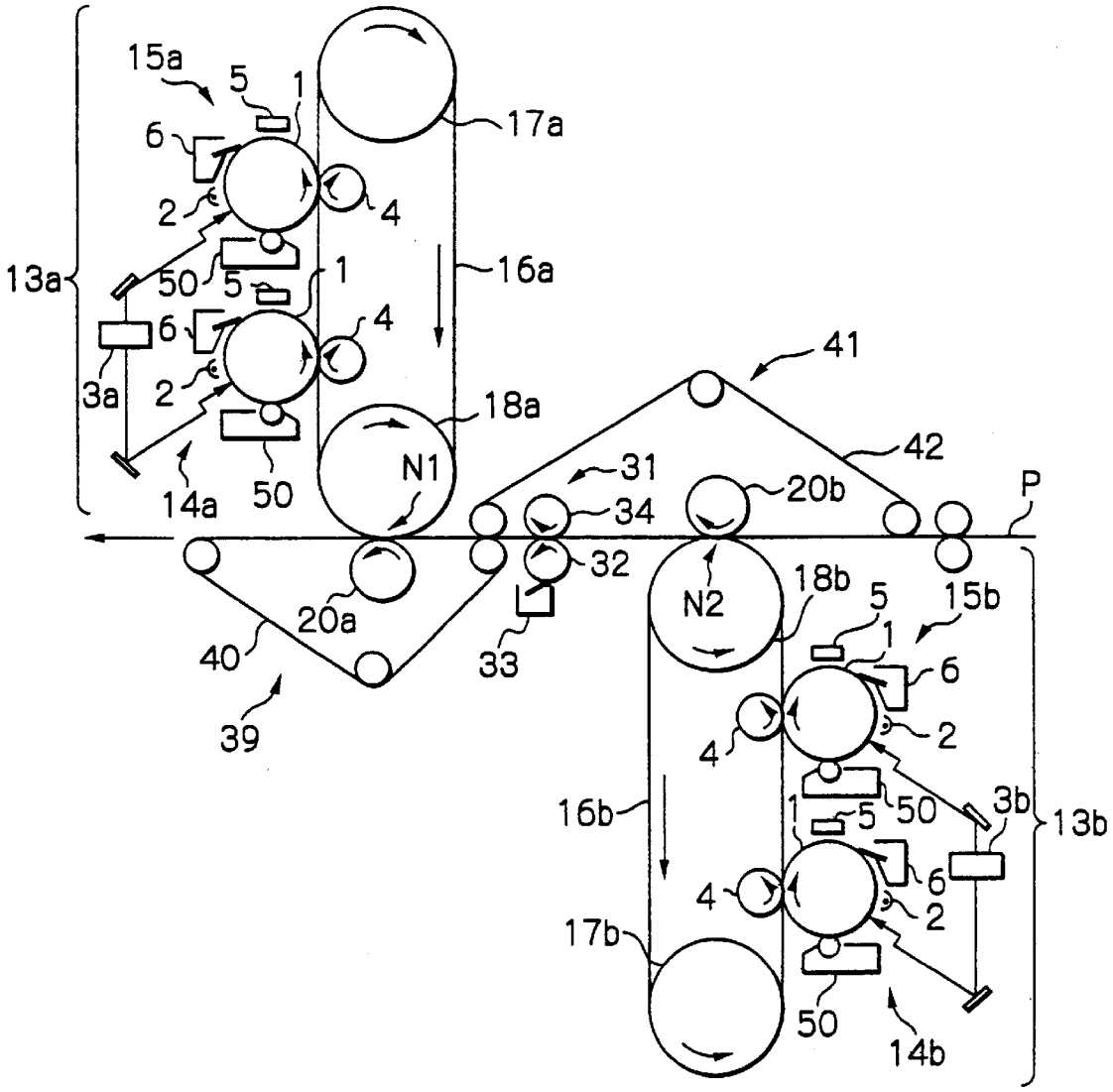
FIG. 13 is a view showing a first embodiment of the present invention.

As shown in FIG. 13, we prepared a test printer in which the first and second image forming units 13*a* and 13*b* were not aligned, but were shifted from each other. The first image forming unit 13*a* includes a driven drum 18*a* and a secondary image transfer roller (simply transfer roller hereinafter) 20*a* contacting each other with the intermediary of the belt 16*a*, forming a nip N1 for secondary image transfer. Likewise, the second image forming unit 13*a* includes a driven drum 18*b* and a secondary image transfer roller (simply image transfer roller hereinafter) 20*b* contacting each other with the intermediary of the belt 16*b*, forming a nip N2 for secondary image transfer. A power supply applies a DC bias of −1,000 V for secondary image transfer to each of the transfer rollers 20*a* and 20*b*.

The configuration shown in FIG. 13 further includes a first conveying unit 39, a second conveying unit 41, and an oil removing unit or carrier absorbing means 31.

The second conveying unit 41 includes a belt 42 passed over a plurality of rollers and caused to move via the nip N2 and oil removing unit 31. The belt 42 conveys the sheet P via the nip N2 and oil removing unit 31 while retaining it thereon. The oil removing unit 31 includes a remover 32 implemented as a roller, a cleaner 33, and a backup roller 34. The remover 32 nips the sheet P between it and the backup roller 34 and removes silicone oil from the reverse side of the sheet P. The removed silicone oil is collected by the cleaner 33. The backup roller 34 is connected to a DC power supply, not shown, in order to obstruct reverse transfer of toner to the remover 32, which contacts the reverse side of the sheet P.

The first conveying unit 39 includes a belt 40 passed over a plurality of rollers and caused to move via the nip N1. The belt 40 retains the sheet P moved away from the oil removing unit 31 and conveys it to a fixing device, not shown, via the nip N1.

In operation, the second image forming unit 13*b* transfers a bicolor toner image to the reverse side of the sheet P arrived at the nip N2. Subsequently, the oil removing unit 31 removes the carrier liquid (silicone oil) from the carrier liquid layer that overlies the toner layer of the bicolor toner image. Thereafter, the first image forming unit 13*a* transfers a bicolor toner image to the front side of the sheet P arrived at the nip N1.

While the remover 32 of the illustrative embodiment is implemented as a rubber roller, it may alternatively be implemented as a sponge roller or a photogravure roller, if desired.

The illustrative embodiment was actually operated to transfer bicolor toner images to both sides of an OHP sheet, which is not liquid-absorptive. It was found that two bicolor toner images were desirably transferred to both sides of the OHP sheet without the bicolor toner image transferred to the reverse side of the sheet at the nip N2 being reversely transferred to the belt 16*a* at the nip N1. This is presumably because the remover 32 removed the carrier liquid from the carrier liquid layer of the bicolor toner image transferred to the rear side of the OHP sheet; the amount of carrier liquid on the toner layer was great enough to implement the role of a parting layer, but too small to implement the role of an electrophoresis medium.

Figure 14:
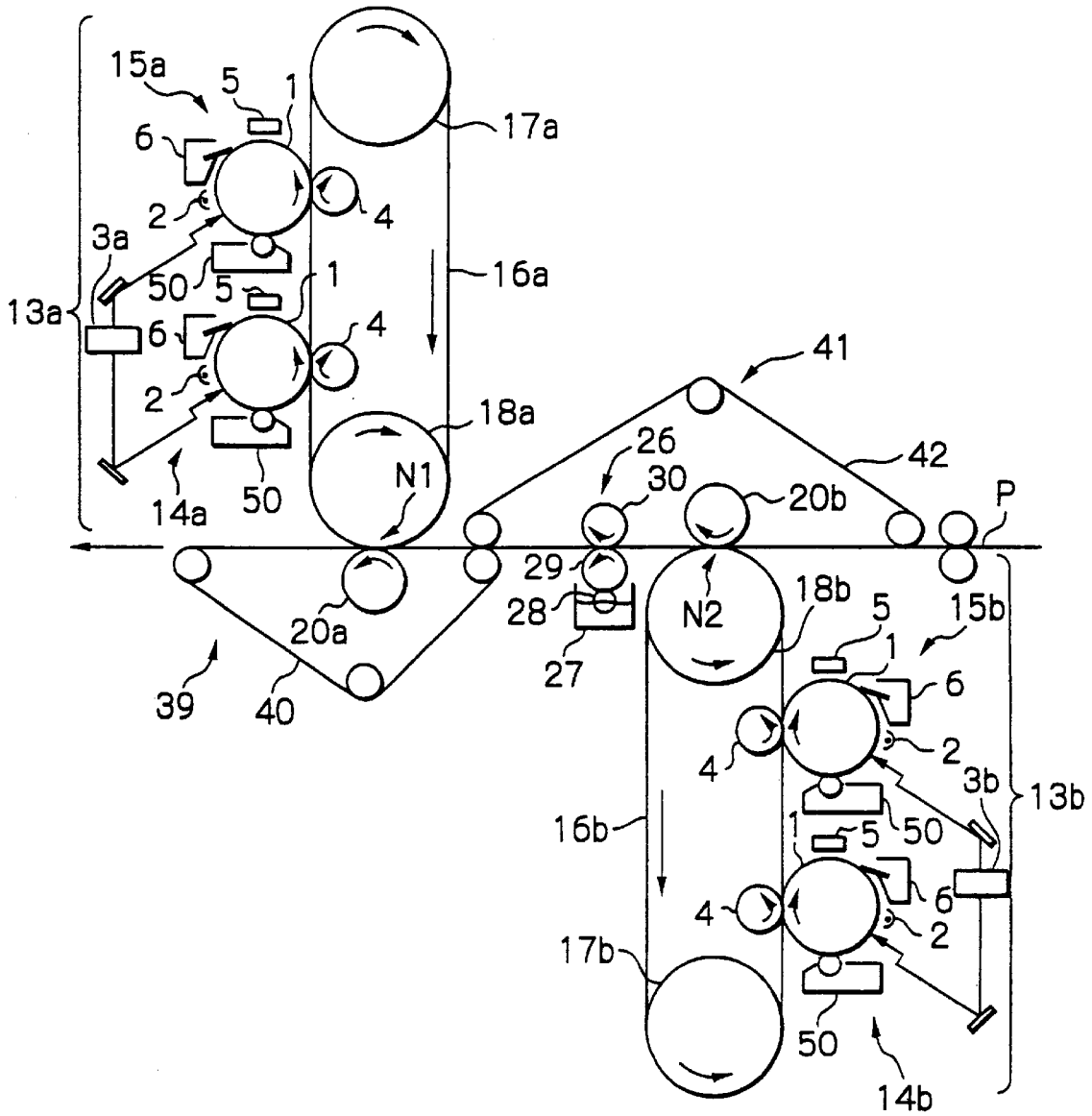
FIG. 14 is a view showing a second embodiment of the present invention.

A second embodiment of the present invention will be described with reference to FIG. 14. As shown, this embodiment is identical with the first embodiment except that an oil feeding unit or parting agent feeding means 26 is substituted for the oil removing unit 31. The oil feeding unit 26 includes an oil tank 27, a scoop roller 28, a feed roller 29, and a backup roller 30. The oil tank 27 stores silicone oil identical with the carrier liquid of the developing liquid. The scoop roller 28 scoops up the silicone coil to the feed roller 29 while the feed roller 29 applies the silicone oil to the reverse side of the sheet P. The backup roller 30 nips the sheet P between it and the feed roller 29 so as to back up the feed of the silicone oil by the feed roller 29 to the sheet P. The backup roller 30 is connected to a DC power supply, not shown, in order to obstruct the reverse transfer of toner to the feed roller 29, which contacts the reverse side of the sheet P.

In operation, the second image forming unit 13*b* transfers a bicolor toner image to the reverse side of the sheet P arrived at the nip N2. Subsequently, the oil feeding unit 26 feeds silicone oil to the carrier liquid layer on the toner layer of the bicolor toner image. Thereafter, the first image forming unit 13*a* transfers a bicolor toner image to the front side of the sheet at the nip N1.

The illustrative embodiment was actually operated to transfer bicolor toner images to both sides of a porous sheet, which is highly liquid-absorptive. It was found that two bicolor toner images were desirably transferred to both sides of the porous sheet without the bicolor toner image transferred to the reverse side of the sheet at the nip N2 being reversely transferred to the belt 16*a* at the nip N1. This is presumably because although the porous sheet absorbed most of the carrier liquid at the nip N2, silicone oil applied to the toner layer allowed the carrier liquid to serve as a parting agent.

Figure 15:
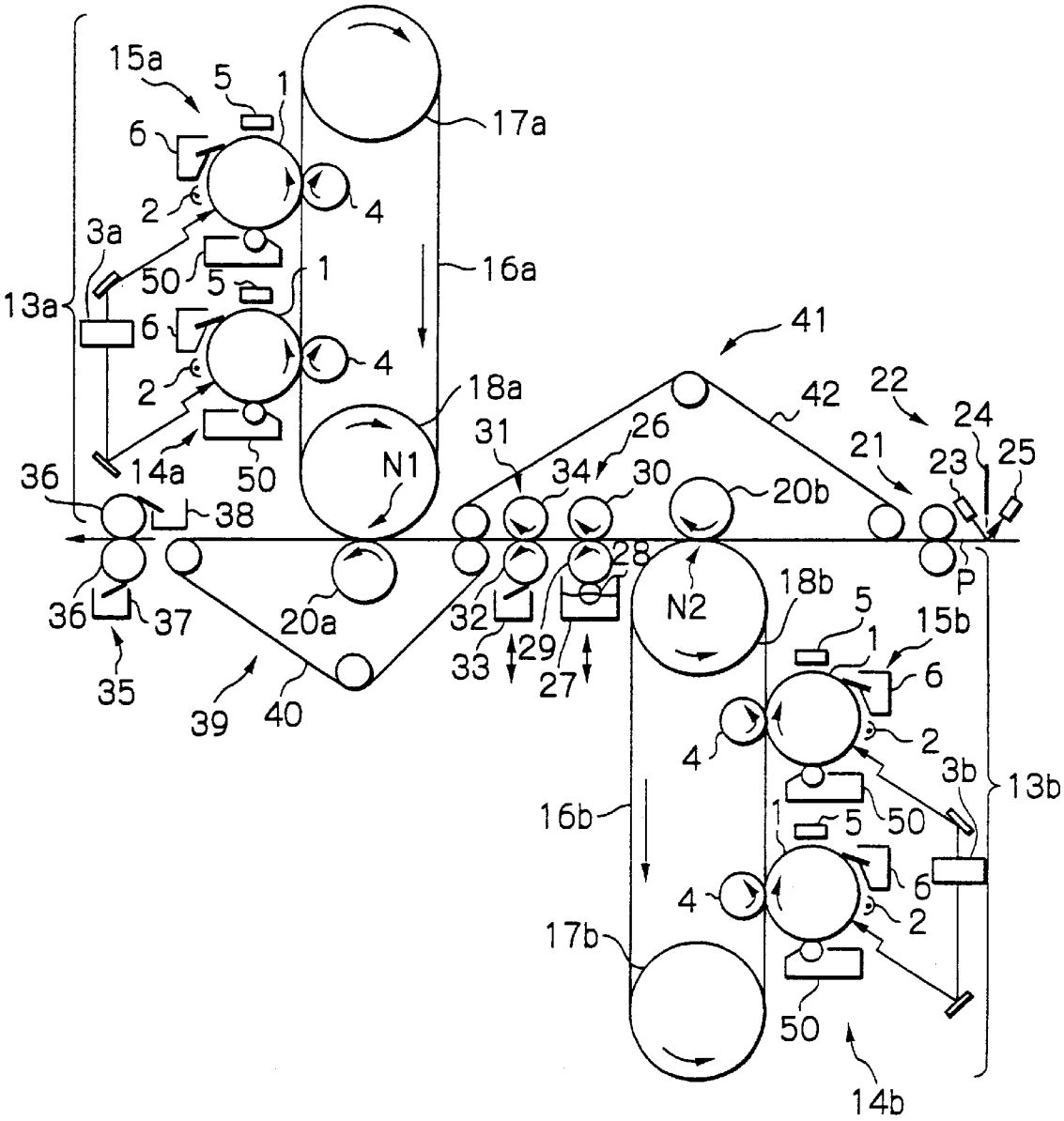
FIG. 15 is a view showing a third embodiment of the present invention.

FIG. 15 shows a third embodiment of the present invention. As shown, this embodiment includes both of the oil removing unit 31 and oil feeding unit 26. In the illustrative embodiment, the oil removing unit 31 and oil feeding unit 26 each are movable up and down, as needed. Specifically, a moving mechanism assigned to the oil removing unit 31 selectively moves the remover 32 and cleaner 34 upward or downward. This allows the remover 32 to selectively contact the sheet P or to vary a pressure to act between the sheet P and remover 32. As a result, the moving mechanism selectively interrupts the removal of the carrier liquid from the sheet P or adjusts the amount of removal. Another moving mechanism assigned to the oil feeding unit 26 selectively moves the oil tank 27, scoop roller 28 and feed roller 29 upward or downward in order to interrupt the feed of silicone oil to the sheet P or to adjust the amount of feed.

The illustrative embodiment additionally includes a registration roller pair 21, a liquid absorbability testing unit 22, and a blotter unit 35.

The registration roller pair 21 nips the sheet P fed from the sheet feeder, not shown, and then drives it toward the nip at a preselected timing.

The liquid absorbability testing unit 22 includes an LED (Light Emitting Diode) or similar light emitting device 23, an oil dropper 24, and a light-sensitive device 25. The oil dropper 24 is communicated to oil conveying means, not shown, and drops silicone oil on the sheet P nipped by the registration roller pair 21. This silicone oil is identical with the carrier liquid of the developing liquid. After a preselected period of time has elapsed since the drop of silicone oil on the sheet P, but before the registration roller pair 21 drives the sheet P toward the nip N2, the light emitting device 23 emits light toward the part of the sheet P where silicone oil is present. The resulting reflection from the sheet P is incident to the light-sensitive device 25. The quantity of light incident to the light-sensitive device 25 varies in accordance with the amount of silicone oil remaining on the surface of the sheet P. It is therefore possible to determine the liquid absorbability of the sheet P in terms of the quantity of light incident to the light-sensitive device 25.

In the blotter unit 35, a blotter roller pair 36 nips the sheet P carrying toner images on both sides thereof and being conveyed toward the fixing unit, thereby removing excess silicone coil (carrier liquid). Cleaners 37 and 38 collect the removed carrier liquid from the blotter roller pair 36. Silicone oil used in the illustrative embodiment is nonvolatile and therefore remains in the sheet P even after fixation. Should much silicone oil remain in the sheet P, the sheet P would become tacky. In light of this, the blotter unit 35 removes excess silicone oil from the sheet P.

Figure 16:
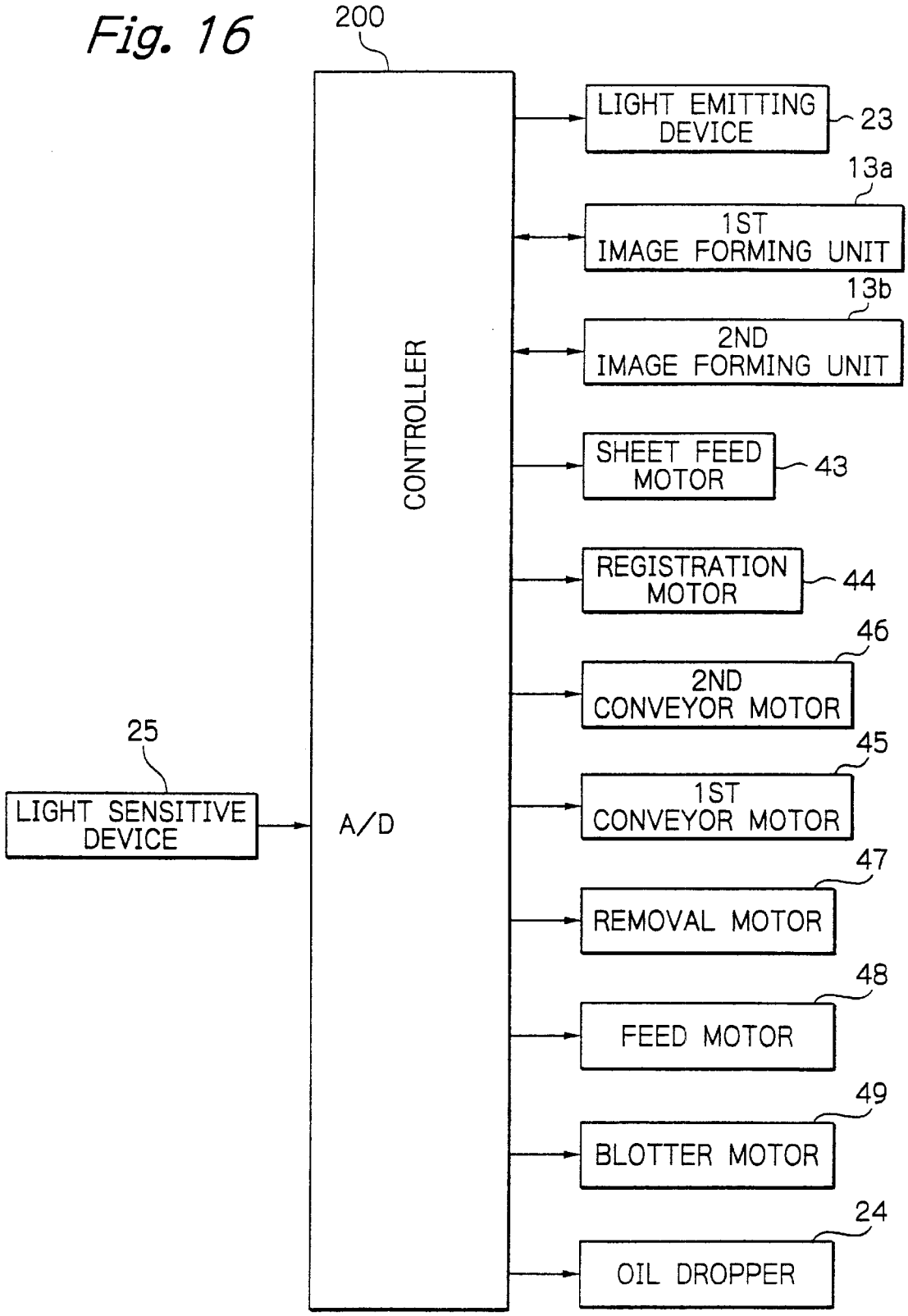
FIG. 16 is a block diagram schematically showing electric circuitry included in the third embodiment.

FIG. 16 shows electric circuitry included in the illustrative embodiment. As shown, the circuitry includes a controller 200 including a CPU (Central Processing Unit), a ROM (Read Only Memory) and a RAM (Random Access Memory) although not shown specifically. Connected to the controller 200 are the structural elements of the first image forming unit 13*a*, the structural elements of the second image forming unit 13*b*, a sheet feed motor 43 included in the sheet feeder, a registration motor for driving the registration roller pair 21, a first conveyor motor 45 for driving the belt 39, and a second conveyor motor 46 for driving the belt 42. Further connected to the controller 200 are the light emitting device 23, oil dropper 24, light-sensitive device 25, a removal motor 47 for driving the moving mechanism assigned to the removing unit 31, a feed motor 48 for driving the moving mechanism assigned to the feeding unit 26, and a blotter motor 49 for driving the blotter roller pair 36.

As soon as the registration roller pair 21 nips the sheet P, the controller 200 causes the oil dropper 24 to drop silicone oil on the front side of the sheet P. Subsequently, on the elapse of a preselected period of time, the controller 200 causes the light emitting device 23 to emit light ward the part of the sheet P where silicone coil is present. The resulting reflection from the sheet P is incident to the light-sensitive element 25. The higher the rate the sheet P absorbs oil, the smaller the amount of oil to remain on the surface of the sheet P and therefore the lower the reflectance of the sheet P. Therefore, the quantity of light to be incident to the light-sensitive device 25 decreases with an increase in the rate of oil absorption of the sheet P.

We determined an oil absorption rate with various kinds of sheet P including a plain sheet, a coated sheet and an OHP sheet. Also, we experimentally determined a relation between the oil absorption rate of the sheet P and image forming conditions adequate therefor. The image forming conditions include a feed pressure between the feed roller 29 and the sheet P and a removal pressure between the remover 32 and the sheet P. The ROM of the controller 200 stores image forming conditions determined by such experiments. More specifically, the table shows correspondence between oil absorption rates and feed and removal pressures adequate therefor.

The controller 200 converts analog data output from the light-sensitive device 25 to digital data to thereby determine a quantity of incident light. The controller 200 then calculates the oil absorption rate of the sheet P on the basis of the quantity of incident light and then finds a removal pressure and a feed pressure matching with the oil absorption rate. The controller 200 then controls the removal motor 27 and feed motor 48 to set up the above removal pressure and feed pressure. Thereafter, the controller 200 drives the registration motor 44, so that the sheet P is driven toward the nip N2.

The printer of the illustrative embodiment was actually operated to transfer images to both sides of various kinds of sheets randomly stacked on the sheet feeder. Then, attractive bicolor toner images were successfully transferred to both sides of each sheet P without regard to the kind of the sheet P, presumably for the following reason. The amount of silicone oil to be removed or fed to the sheet P was adequately controlled in accordance with the liquid absorbability of the sheet P. As a result, the carrier liquid remains on the toner layer in an amount sufficient to serve as a parting agent between the toner layer and the belt 16*a*, but too small to serve as an electrophoresis medium.

A fourth embodiment of the present invention will be described with reference to FIG. 17. As shown, this embodiment differs from the first embodiment mainly in that it does not include the oil removing unit 31. In the illustrative embodiment, the developing devices 50 of the image forming units 13*a* and 13*b* each include a sweep roller 51*b*. In addition, the second image forming unit 13*b* includes an adjustment roller pair 85.

Figure 18:
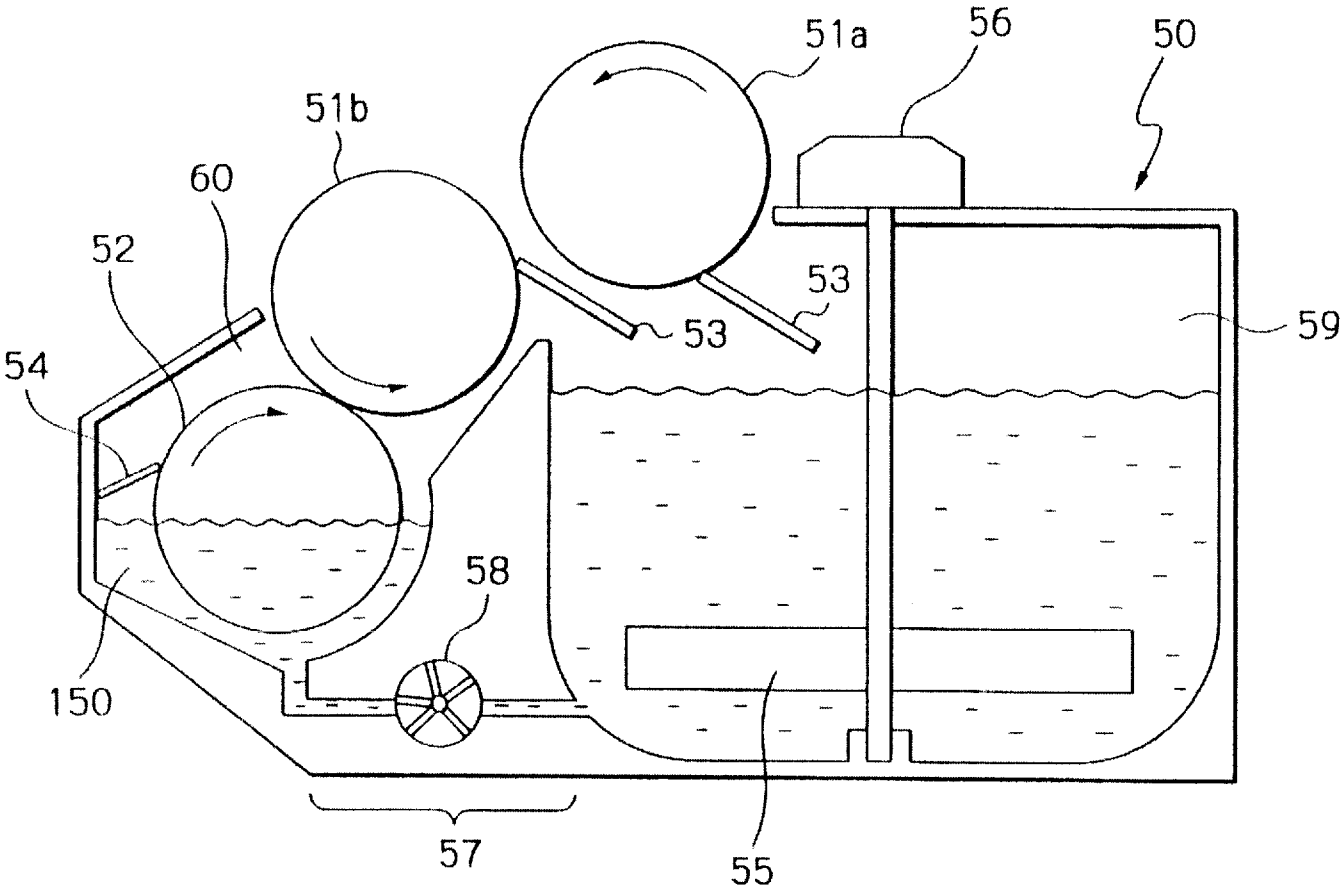
FIG. 18 is a view showing a developing device included in the fourth embodiment.

As shown in FIG. 18, the sweep roller 51*b* adjoins the developing roller 51*a* and rotates in contact with the photoconductive drum, not shown, forming a sweep nip between the roller 51*b* and the drum. An identical bias is applied to both of the developing roller 51*a* and sweep roller 51*b*. Part of the toner fails to reversely migrate to the developing roller 51*a* by electrophoresis at the developing position and remains on the non-image portion of the photoconductive drum. The sweep roller 51*b* causes such part of the toner to deposit thereon by reverse electrophoresis. The cleaning blade 53 scrapes off the toner and carrier liquid deposited on the sweep roller 51*b* and returns it to the tank 59. The sweep roller 51*b* therefore reduces background contamination ascribable to the short reverse electrophoresis of the toner at the developing position. A moving mechanism assigned to the sweep roller 5*a* selectively moves the roller 51*a* toward or away from the photoconductive drum so as to control a sweep nip pressure.

Figure 17:
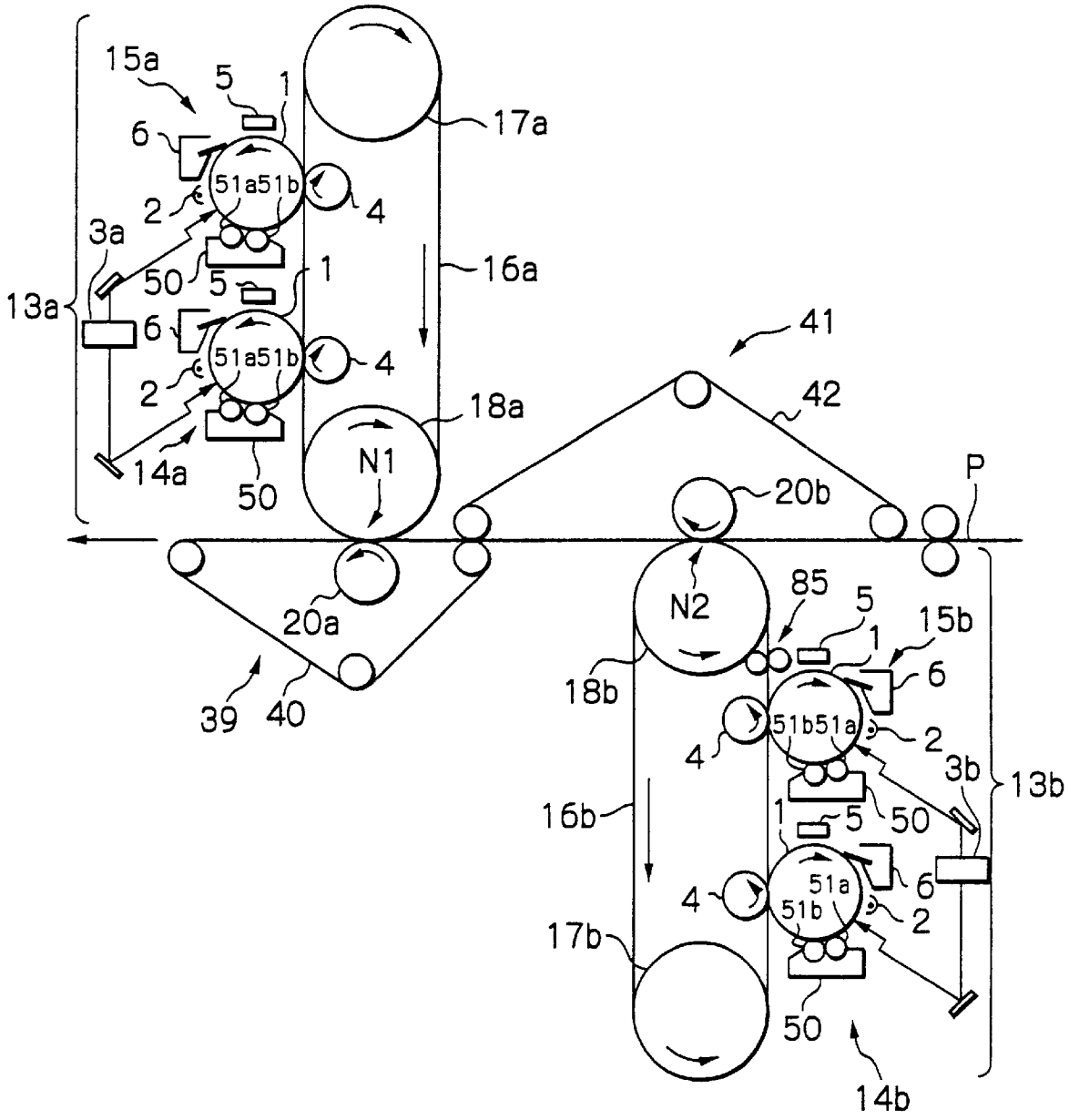
FIG. 17 is a view showing a fourth embodiment of the present invention.

As shown in FIG. 17, the adjustment roller pair 85 nips the belt 16*b* at a position downstream of primary image transfer positions, but upstream of the secondary image transfer position, in the direction of movement of the belt 16*b*. One roller of the adjustment roller pair 85 contacting the outer surface of the belt 16*b* removes the carrier liquid from the bicolor toner image formed on the belt 16*b*. A moving mechanism assigned to this roller selectively moves the above roller toward or away from the belt 16*b* so as to control a contact pressure between the roller and the other roller. This varies the amount of carrier liquid to be removed from the bicolor toner image formed on the belt 16*b*. A cleaner, not shown, collects the carrier liquid removed by the roller contacting the outer surface of the belt 16*b*.

Three different methods are available with the illustrative embodiment for controlling the amount of carrier liquid to be transferred to the front side of the sheet P at the nip N1 of the first image forming unit 13*a*. A first method is to vary the rotation speed of the coating roller 52 in each of the developing devices 50 of the image forming devices 15*b* and 16*b* (see FIG. 18). A change in the linear velocity ratio between the developing roller 51*a* and the coating roller 52 translates into a change in the amount of developing liquid to be coated on the developing roller 51*a*. Consequently, the amount of carrier liquid contained in each monocolor image formed at the developing position varies. This, of course, varies the amount of carrier liquid contained in the resulting bicolor toner image and in the bicolor toner image transferred to the sheet P. Alternatively, a moving mechanism may move the developing roller 51*a* in such a manner as to vary the pressure between the roller 51*a* and the drum 1.

A second method is to vary the sweep nip pressure by moving the sweep roller 51*b*. A change in sweep nip pressure translates into a change in the amount of liquid carrier to be removed from the monocolor toner image by the sweep roller 51*b*. Consequently, the amount of carrier liquid contained in the bicolor toner image transferred to the sheet P varies. A third method is to vary the contact pressure acting between the adjustment rollers 85. This method varies the amount of carrier liquid to be removed from the bicolor toner image formed on the belt 16*b*.

For experiment, the linear velocity ratio between the developing roller 51*a* and the coating roller 52 was lowered for a sheet P having relatively high liquid absorbability or raised for a sheet P of the kind having relatively low liquid absorbability. It was found that bicolor toner images could be desirably transferred to various kinds of sheets P different in liquid absorbability. Reverse transfer, however, occurred with a porous sheet having high absorbability and an OHP sheet lacking absorbability.

A fifth embodiment of the present invention is identical with the fourth embodiment except for the following. The sweep nip pressure is varied in place of the linear velocity ratio between the developing roller 51*a* and the coating roller 52 in accordance with the liquid absorbability of the sheet P. It was experimentally found that bicolor toner images were desirably transferred to various kinds of sheets P other than a porous sheet and an OHP sheet.

A sixth embodiment of the present invention is also identical with the fourth embodiment except that the contact pressure between the adjustment rollers 85 is varied in place of the linear velocity ratio or the sweep nip pressure in accordance with the liquid absorbability of the sheet P. This embodiment, like the forth and fifth embodiments, sometimes brought about reverse transfer when a porous sheet and an OHP sheet were used.

The fourth, fifth and sixth embodiments are not free from reverse transfer when it comes to a porous sheet and an OHP sheet, as stated above. This is presumably because the three different methods each cannot sufficiently adjust the amount of carrier liquid deposited on such a sheet alone.

Figure 19:
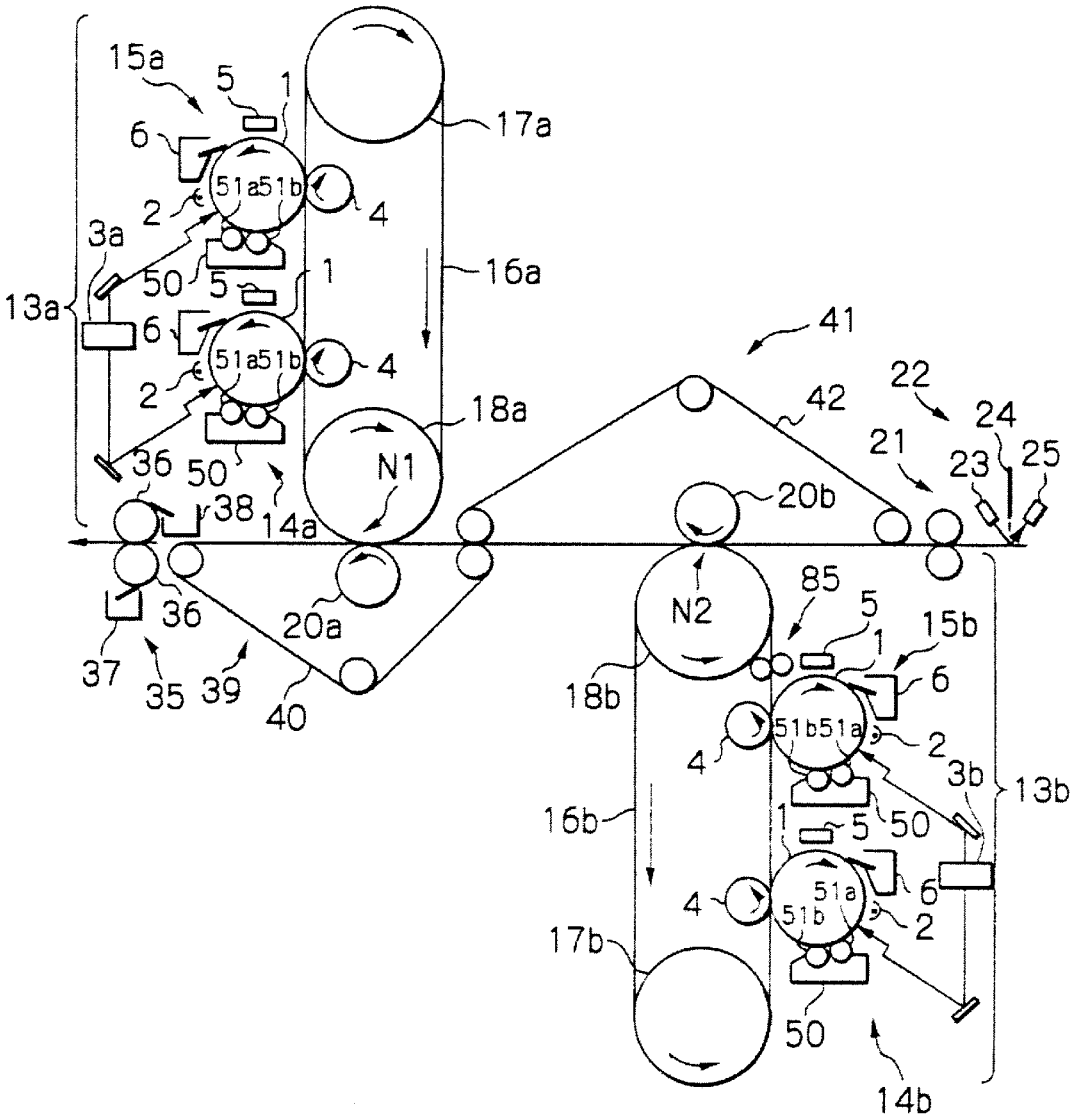
FIG. 19 is a view showing a seventh embodiment of the present invention.
Figure 20:
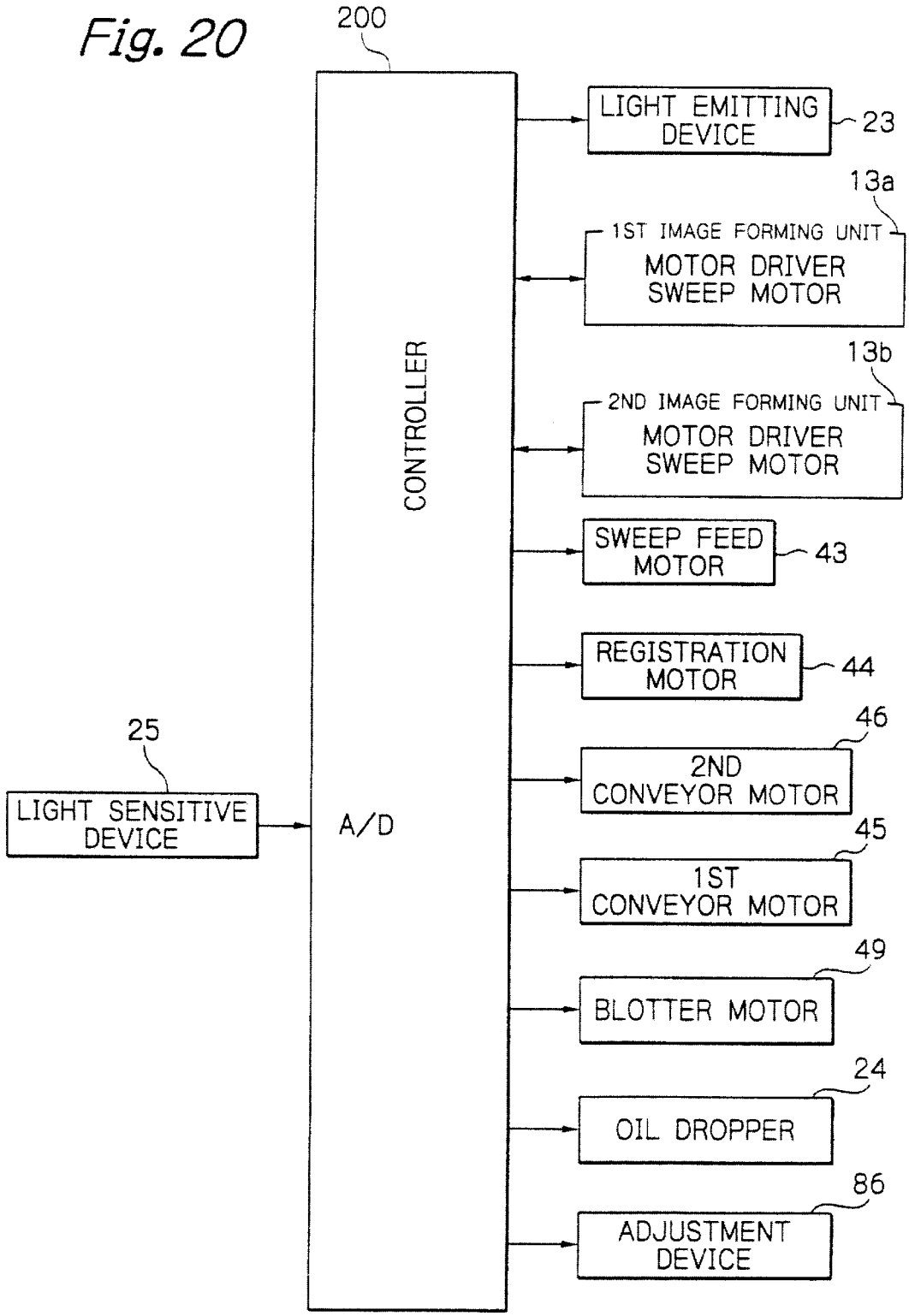
FIG. 20 is a block diagram showing electric circuitry included in the seventh embodiment.

FIG. 19 shows a seventh embodiment of the present invention identical with the fourth embodiment except that it additionally includes the configuration of the absorbability testing unit 22, FIGS. 7 and 8. FIG. 20 shows electric circuitry included in the illustrative embodiment. As shown, an adjustment roller motor 86 for driving the moving mechanism, which is assigned to one of the two adjustment rollers 85, is connected to the controller 200. The first and second image forming units 13*a* and 13*b* each include a motor driver for driving the two coating roller 52 and a sweep motor for driving the two moving mechanisms assigned to the two sweep rollers 51*b*.

We experimentally determined an oil absorption rate with each of various kinds of sheets P including a plain sheet, a coated sheet, and an OHP sheet, as stated earlier. We conducted a series of extended researches and experiments to determine a relation between the oil absorption rate and the combination of linear velocity ratio, sweep nip pressure and contact pressure of the adjustment roller pair 85. The ROM of the controller 200 stores a table listing data representative of image forming conditions determined by the experiments.

The controller 200 selects the combination of a linear velocity ratio, a sweep nip pressure and a contact pressure adequate for the liquid absorbability of a sheet P on the basis of analog data output from the light-sensitive device 25 and the table stored in the ROM. The controller 200 then sends control signals to the coating roller motor drivers, sweep motors, and adjustment roller motor 86. In response, the drivers and motors set up the rotation speed of the coating rollers 52, the displacement of the sweep rollers 51*a* and the displacement of one adjustment roller satisfying the above conditions.

The printer of the illustrative embodiment was operated to transfer images to both sides of various kinds of sheets P randomly stacked on the sheet feeder. The printer, like the printer of the third embodiment, successfully transferred attractive bicolor toner images to both sides of each sheet P without regard to the kind of the sheet P. This is presumably because the three different methods in combination sufficiently adjusted the amount of carrier liquid deposited even on a porous sheet or an OHP sheet.

For comparison, a duplex image transfer test was conducted with a printer using dry toner and from which a fixing unit was removed. Specifically, a plain sheet and a coated sheet each were passed through the printer to form a toner image on one side thereof. Subsequently, the sheet was again passed through the printer to form a toner image on the other side thereof. The toner image transferred to the sheet first was halved in density and moreover noticeably disfigured or lost part of its solid portion.

Also, after the formation of a toner image on one side of the plain sheet or the coated sheet, a roller applied silicone oil to the toner image. Subsequently, a toner image was formed on the other side of the sheet. Silicone oil, however, improved the situation little and could not prevent the toner image from being halved in density or disfigured. This is presumably because adhesion acting between dry toner grains and between the grains and the sheet P is so weak before the grains are fixed, the grains readily migrate through the silicone oil layer independently of each other.

While the illustrative embodiments have concentrated on a printer of the type including intermediate image transfer belts, the image transfer belts may, of course, be replaced with drums or similar intermediate image transfer bodies.

Figure 21:
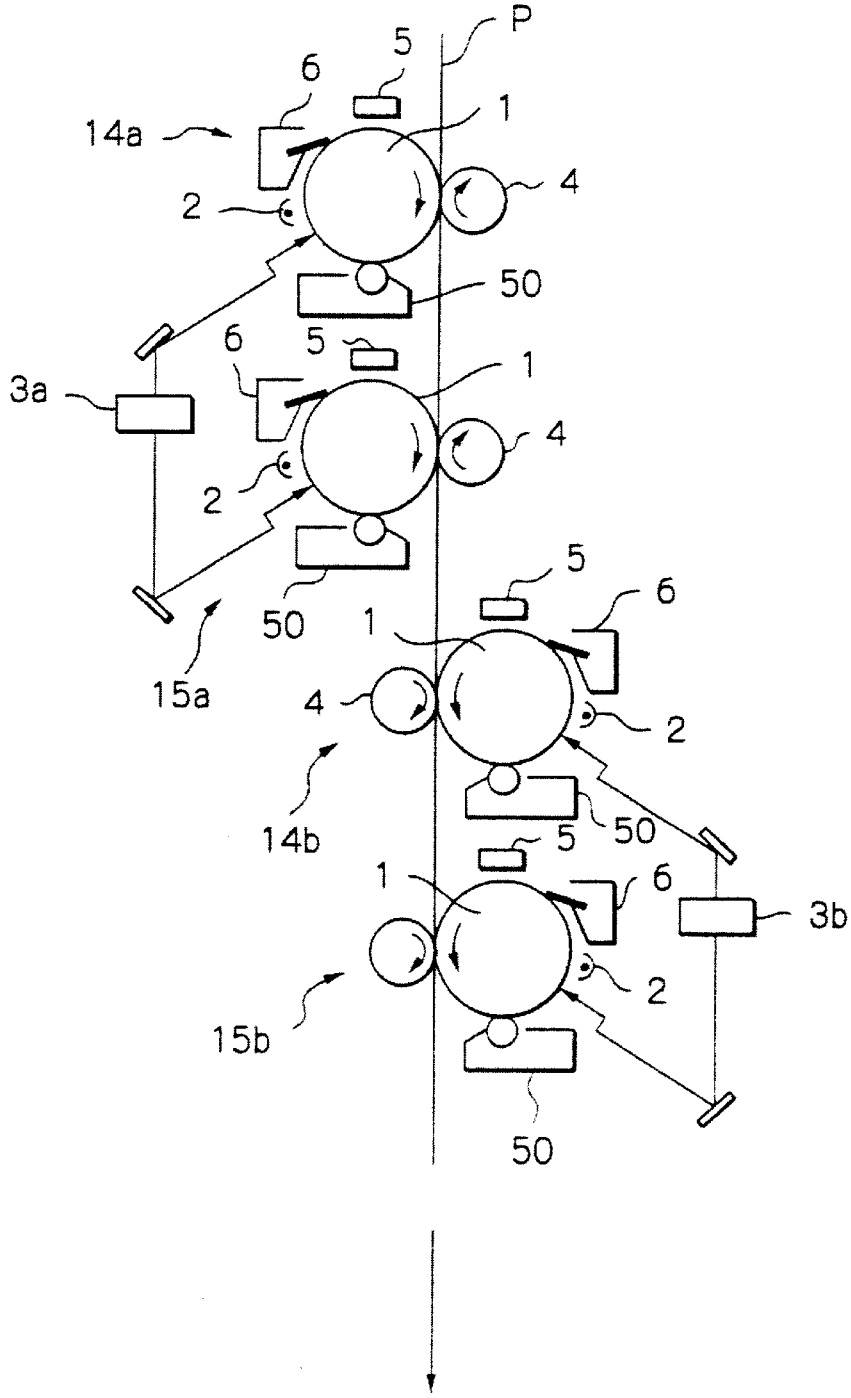
FIG. 21 is a view showing a modification of any one of the illustrative embodiments.

FIG. 21 shows a modification of any one of the embodiments shown and described. As shown, the modification implements duplex image transfer with consecutive primary image transfer steps from the drums 1 to the sheet P, thereby omitting the secondary image transfer. The modification therefore realizes a higher image forming speed than the illustrative embodiments. The present invention is applicable not only to an electrophotographic printer including a photoconductive drum or similar image carrier, but also to a printer of the type causing a developing liquid to fly toward a recording medium with piezoelectric elements and electrodes.

In summary, it will be seen that the present invention provides a duplex image transferring device and an image forming apparatus using the same having various unprecedented advantages, as enumerated below.

(1) The device can transfer toner images to both sides of a sheet without switching back the sheet carrying a toner image on one side thereof, without using two kinds of toner each being chargeable to particular polarity, or without charging one toner image to the opposite polarity with a corona charger.

(2) When a carrier liquid sufficient in amount to play the role of a parting agent is not left on a toner layer, a parting liquid is fed to the carrier liquid in order to obstruct the reverse transfer of a first toner image.

(3) Assume that the amount of carrier liquid left on the toner layer is great enough to serve as an electrophoresis medium rather than a parting agent. Then, the carrier liquid is absorbed from the carrier liquid in order to obstruct the reverse transfer of the first toner image.

(4) A carrier liquid layer capable of serving as a parting agent is surely formed on the toner layer.

(5) The reverse transfer of the first toner image is obstructed without regard to the liquid absorbability of the sheet.

(6) Control means automatically adjusts conditions for driving parting agent feeding means or carrier absorbing means.

(7) An intermediate image transfer body implemented as an elastic belt is more desirable than one implemented as a rigid photoconductive drum because it can closely contact the sheet and therefore realizes attractive images.

(8) An image forming speed can be increased.

(9) The thickness of the developing liquid layer being conveyed toward a developing position is adjusted. This allows the amount of carrier liquid on the toner layer without resorting to the parting liquid feeding means or the carrier absorbing means.

(10) Only if the thickness of the first toner image formed on a first image carrier is adjusted, the amount of carrier liquid on the first image carrier can be adjusted. This also obviates the need for the parting liquid feeding means or the carrier absorbing means.

(11) The thickness of the first toner image on a first intermediate image transfer body is adjusted at a position preceding a secondary image transfer position. This is also successful to adjust the amount of carrier liquid on the toner layer without resorting to the parting liquid feeding means or the carrier absorbing means.

Various modifications will become possible for those skilled in the art after receiving the teachings of the present disclosure without departing from the scope thereof.

What is claimed is:

1. A duplex image transferring method comprising:

a first step of bringing one side of a recording medium into contact with a first toner image, which is formed on a first image carrier by a colored liquid containing toner and a carrier liquid, and causing a first electric field to act toward said recording medium in a forward direction to thereby transfer said first toner image to said one side of said recording medium, while causing a toner layer gathered at said recording medium and a carrier liquid layer left on said first image carrier to part from each other; and a second step of bringing the other side of said recording medium into contact with a second toner image formed on a second image carrier by the color liquid while maintaining the first toner image, in which the liquid carrier layer contains the carrier liquid of an amount not great enough to serve as an electrophoresis medium for the toner layer, but sufficient to serve as a parting agent for said toner layer and a contact member contacting said toner layer, on the one side of said recording medium, and causing a second electric field, which acts toward said recording medium and forward for said second toner image, but reverse for said first toner image, to act on said second toner image and said first toner image to thereby transfer said second toner image to said other side of said recording medium.

2. A duplex image transferring device comprising:

first image transferring means for bringing one side of a recording medium into contact with a first toner image, which is formed on a first image carrier by a colored liquid containing toner and a carrier liquid, and causing a first electric field to act toward said recording medium in a forward direction to thereby transfer said first toner image to said one side of said recording medium, while causing a toner layer gathered at said recording medium and a carrier liquid layer left on said first image carrier to part from each other; and second image transferring means for bringing the other side of said recording medium into contact with a second toner image formed on a second image carrier by the color liquid while maintaining the first toner image, in which the liquid carrier layer contains the carrier liquid of an amount not great enough to serve as an electrophoresis medium for the toner layer, but sufficient to serve as a parting agent for said toner layer and a contact member contacting said toner layer, on the one side of said recording medium, and causing a second electric field, which acts toward said recording medium and forward for said second toner image, but reverse for said first toner image, to act on said second toner image and said first toner image to thereby transfer said second toner image to said other side of said recording medium.

3. The apparatus as claimed in claim 2, further comprising parting liquid feeding means for feeding a parting liquid to the first toner image transferred to the recording medium for thereby causing said first toner image and said first image carrier to part from each other, wherein said parting liquid feeding means is positioned on a recording medium conveying path between said first image transferring means and said second image transferring means.

4. The apparatus as claimed in claim 3, further comprising carrier absorbing means positioned on said recording medium conveying path between said first transferring means and said second image transferring means for absorbing the carrier liquid from the first toner image transferred to the one side of the recording medium.

5. An image forming method for forming toner images on both sides of a recording medium, said image forming method comprising:

a first toner image forming step of forming a first toner image on a first image carrier;

a second toner image forming step of forming a second toner image on a second image carrier;

a first transferring step of transferring the first toner image from said first image carrier to one side of a recording medium; and a second transferring step of transferring the second toner image from said second image carrier to the other side of the recording medium;

wherein said first toner image forming step and said second toner image forming step each use a colored liquid containing of toner and a carrier liquid, said first transferring step comprises bringing one side of a recording medium into contact with the first toner image, which is formed on said first image carrier by the colored liquid, and causing a first electric field to act toward said recording medium in a forward direction to thereby transfer said first toner image to said one side of said recording medium, while causing a toner layer gathered at said recording medium and a carrier liquid layer left on said first image carrier to part from each other, and said second transferring step comprises bringing the other side of the recording medium into contact with the second toner image formed on said second image carrier by the color liquid while maintaining the first toner image, in which the liquid carrier layer contains the carrier liquid of an amount not great enough to serve as an electrophoresis medium for the toner layer, but sufficient to serve as a parting agent for said toner layer and a contact member contacting said toner layer, on the one side of said recording medium, and causing a second electric field, which acts toward said recording medium and forward for said second toner image, but reverse for said first toner image, to act on said second toner image and said first toner image to thereby transfer said second toner image to said other side of said recording medium.

6. An image forming apparatus for forming toner images on both sides of a recording medium, said image forming apparatus comprising:

a first image carrier for forming a first toner image thereon;

a second image carrier for forming a second toner image thereon;

first toner image forming means for forming the first toner image on said first image carrier;

second toner image forming means for forming the second toner image on said second image carrier; and a duplex image transferring device for transferring the first toner image from said first image carrier to one side of a recording medium and then transferring the second toner image from said second image carrier to the other side of said recording medium;

wherein said first toner image forming means and said second toner image forming means use a color liquid consisting of toner and a carrier liquid; and said duplex image transferring device comprises:

first image transferring means for bringing the one side of the recording medium into contact with the first toner image, and causing a first electric field to act toward said recording medium in a forward direction to thereby transfer said first toner image to said one side of said recording medium, while causing a toner layer gathered at said recording medium and a carrier liquid layer left on said first image carrier to part from each other; and second image transferring means for bringing the other side of the recording medium into contact with the second toner image while maintaining the first toner image, in which the liquid carrier layer contains the carrier liquid of an amount not great enough to serve as an electrophoresis medium for the toner layer, but sufficient to serve as a parting agent for said toner layer and a contact member contacting said toner layer, on the one side of said recording medium, and causing a second electric field, which acts toward said recording medium and forward for said second toner image, but reverse for said first toner image, to act on said second toner image and said first toner image to thereby transfer said second toner image to said other side of said recording medium.

7. The apparatus as claimed in claim 6, wherein the carrier liquid comprises silicone oil.

8. The apparatus as claimed in claim 6, further comprising liquid absorbability determining means for determining liquid absorbability of the recording medium.

9. The apparatus as claimed in claim 8, further comprising parting agent feeding means for feeding to the first toner image transferred to the one side of the recording medium a parting liquid that causes the first toner image and said first image carrier to part from each other, said parting agent feeding means being positioned on a recording medium conveying path between said first image transferring means and said second image transferring means.

10. The apparatus as claimed in claim 9, further comprising carrier absorbing means positioned on said recording medium conveying path between said first transferring means and said second image transferring means for absorbing the carrier liquid from the first toner image transferred to the one side of the recording medium.

11. The apparatus as claimed in claim 10, further comprising control means for controlling said parting agent feeding means and said carrier absorbing means in accordance with a result of decision output from said liquid absorbability determining means.

12. The apparatus as claimed in claim 6, wherein said first image carrier comprises a first intermediate image transfer body to which the first toner image, which is developed by a developing device using the colored liquid as a developing liquid, is transferred, said second image carrier comprises a second intermediate image transfer body to which the second toner image, which is developed by a developing device using the color liquid, is transferred, said first toner image forming means comprises primary image transferring means for transferring the first toner image to said first intermediate image transfer body, and said second toner image forming means comprises primary image transferring means for transferring the second toner image to said second intermediate image transfer body.

13. The apparatus as claimed in claim 6, wherein said first toner image forming means comprises latent image forming means for forming a latent image on said first image carrier, and a developing device for developing said latent image with the colored liquid, and said second toner image forming means comprises latent image forming means for forming a latent image on said second image carrier, and a developing device for developing said latent image with the colored liquid.

14. The apparatus as claimed in claim 13, wherein said developing device comprises:

a developer carrier for conveying the toner of the colored liquid deposited thereon to a developing position; and adjusting means for adjusting a liquid thickness of a layer formed by the colored liquid on said developer carrier.

15. The apparatus as claimed in claim 6, further comprising image thickness adjusting means for adjusting a thickness of the first toner image formed on said first image carrier in contact with said first toner image.

16. The apparatus as claimed in claim 15, further comprising pretransfer image thickness adjusting device for adjusting a thickness of the first toner image formed on said first intermediate image transfer body in contact with said first toner image before secondary image transfer.

17. The apparatus as claimed in claim 16, further comprising liquid absorbability determining means for determining liquid absorbability of the recording medium.

18. The apparatus as claimed in claim 17, further comprising control means for controlling at least one of said developing device, said image thickness adjusting means and said pretransfer image thickness adjusting means.

19. The apparatus as claimed in claim 6, wherein said second toner image forming means causes the toner of the colored liquid to electrostatically migrate to said second image carrier to thereby form the second toner image, and said second image carrier exerts adhesion on the toner that is weaker than adhesion acting between grains of said toner.

* * * * *

UNITED STATES PATENT AND TRADEMARK OFFICE

CERTIFICATE OF CORRECTION

PATENT NO. : 6,597,887 B2
DATED : July 22, 2003
INVENTOR(S) : Sakai et al.

It is certified that error appears in the above-identified patent and that said Letters Patent is hereby corrected as shown below:

Title page,
Item [75], Inventor, should read:
-- [75] Inventors: Katsuo Sakai, Yokohama (JP); Shunichi Abe, Yokohama (JP); Yuichi Aoyama, Mitaka (JP) --

Signed and Sealed this

Ninth Day of December, 2003

JAMES E. ROGAN
*Director of the United States Patent and Trademark Office*